US007144498B2

(12) United States Patent
McCall et al.

(10) Patent No.: US 7,144,498 B2
(45) Date of Patent: Dec. 5, 2006

(54) SUPERCRITICAL HYDROCARBON CONVERSION PROCESS

(75) Inventors: Thomas F. McCall, Houston, TX (US); Pritham Ramamurthy, Tomball, TX (US); Kiran V. Shah, Sugar Land, TX (US); Michael A. Silverman, Houston, TX (US); Martin John Van Sickels, Spring, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 202 days.

(21) Appl. No.: 10/707,997

(22) Filed: Jan. 30, 2004

(65) Prior Publication Data

US 2005/0167333 A1 Aug. 4, 2005

(51) Int. Cl.

| | |
|---|---|
| ***C10G 11/02*** | (2006.01) |
| ***C10G 11/00*** | (2006.01) |
| ***C10G 51/02*** | (2006.01) |
| ***C10G 65/10*** | (2006.01) |

(52) U.S. Cl. ..... 208/113; 208/118; 208/67; 208/72; 208/77

(58) Field of Classification Search ..... 208/113, 208/118, 67, 72, 77

See application file for complete search history.

(56) References Cited

U.S. PATENT DOCUMENTS

| | | | | |
|---|---|---|---|---|
| 2,756,186 | A | 7/1956 | Owen et al. | 196/49 |
| 3,310,484 | A | 3/1967 | Mason et al. | 208/125 |
| 3,549,519 | A | 12/1970 | Munro et al. | 208/89 |
| 3,817,853 | A | 6/1974 | Folkins | 208/50 |
| 4,178,228 | A | 12/1979 | Chang | 208/72 |
| 4,264,432 | A | 4/1981 | Gartside | 208/48 |
| 4,298,455 | A | 11/1981 | Huang | 208/48 |
| 4,341,619 | A | 7/1982 | Poska | 208/11 |
| 4,354,922 | A | 10/1982 | Derbyshire et al. | 208/68 |
| 4,376,693 | A | 3/1983 | Warzel | 208/11 |
| 4,390,411 | A | 6/1983 | Scinta et al. | 208/111 |
| 4,448,669 | A | 5/1984 | Scinta | 208/11 |
| 4,455,219 | A | 6/1984 | Janssen et al. | 208/131 |
| 4,482,453 | A | 11/1984 | Coombs et al. | 208/309 |
| 4,483,761 | A | 11/1984 | Paspek, Jr. | 208/126 |
| 4,518,487 | A | 5/1985 | Graf et al. | 208/131 |
| 4,548,711 | A | 10/1985 | Coombs | 208/309 |
| 4,557,820 | A | 12/1985 | Paspek, Jr. et al. | 208/8 |
| 4,559,127 | A | 12/1985 | Paspek, Jr. | 208/8 |
| RE32,120 | E | 4/1986 | Low | 208/11 |
| 4,588,476 | A | 5/1986 | Warzel | 196/14.52 |
| 4,592,826 | A | 6/1986 | Ganguli | 208/407 |
| 4,594,141 | A | 6/1986 | Paspek, Jr. et al. | 208/390 |
| 4,604,185 | A | 8/1986 | McConaghy, Jr. et al. | 208/56 |

(Continued)

*Primary Examiner*—Tam M. Nguyen
(74) *Attorney, Agent, or Firm*—Lundeen & Dickenson, LLP; Bradley A. Misley

(57) ABSTRACT

Supercritical conversion of hydrocarbons boiling above 538° C. (1000° F.) with a solvating hydrocarbon at a weight ratio of solvating hydrocarbon to high-boiling hydrocarbons of at least 2:1 and at conditions above the critical temperature and pressure of the high-boiling hydrocarbons-solvent mixture, in the presence of hot fluidized solids. The hydrocarbons are supplied to a reaction zone at a temperature below that of the hot solids supplied thereto, whereby the resulting hydrocarbons-solids suspension has a thermal equilibrium temperature corresponding to the reaction temperature. The conversion has high rates of sulfur, nitrogen and metals removal, nearly complete conversion to lower molecular weight products, high naphtha and distillate selectivity, and low coke formation. The supercritical conversion can replace crude distillation, vacuum distillation, solvent deasphalting, coking, hydrocracking, hydrotreating, and/or fluid catalytic cracking, and/or used in parallel with such unit operations for debottle-necking or increasing capacity.

39 Claims, 14 Drawing Sheets

U.S. PATENT DOCUMENTS 4,604,188 A 8/1986 Yan et al. ..... 208/106
4,615,791 A 10/1986 Choi et al. ..... 208/107
4,640,762 A 2/1987 Woods et al. ..... 208/56
4,642,175 A 2/1987 Rudnick ..... 208/88
4,661,241 A 4/1987 Dabkowski et al. ..... 208/131
4,673,486 A 6/1987 Orihashi et al. ..... 208/86
4,719,000 A 1/1988 Beckberger ..... 208/44
4,784,746 A 11/1988 Farcasiu et al. ..... 208/106
4,818,370 A 4/1989 Gregoli et al. ..... 208/106
4,840,725 A 6/1989 Paspek ..... 208/130
4,855,524 A * 8/1989 Harandi et al. ..... 585/517
4,944,863 A 7/1990 Smith et al. ..... 208/107
4,966,681 A * 10/1990 Herbst et al. ..... 208/74
RE33,728 E * 10/1991 Dean et al. ..... 208/120
5,370,787 A 12/1994 Forbus ..... 208/106
5,443,715 A 8/1995 Grenoble et al. ..... 208/95
5,496,464 A 3/1996 Piskorz et al. ..... 208/48
5,502,262 A 3/1996 Yamasaki et al. ..... 282/241
5,565,616 A 10/1996 Li et al. ..... 585/700
5,578,647 A 11/1996 Li et al. ..... 518/700
5,725,756 A 3/1998 Subramanian et al. ..... 208/48
5,730,859 A * 3/1998 Johnson et al. ..... 208/78
5,785,868 A 7/1998 Li et al. ..... 210/761
5,888,389 A 3/1999 Griffith et al. ..... 210/175
5,914,031 A 6/1999 Sentagnes et al. ..... 208/952
6,123,835 A 9/2000 Ackerson ..... 208/213
6,428,686 B1 8/2002 Ackerson ..... 208/213

* cited by examiner

SUPERCRITICAL HYDROCARBON CONVERSION PROCESS

BACKGROUND OF INVENTION

This invention relates to the conversion of high-boiling hydrocarbons in the presence of a hydrocarbon solvent at mixture supercritical conditions using hot particle heating.

The conversion of high boiling hydrocarbons is economically important in maximizing the production of useable hydrocarbons. Useable hydrocarbons for these purposes are defined as hydrocarbons possessing normal boiling points less than 538° C. (1000° F.). Methods traditionally employed to enhance the recovery of useable hydrocarbons include thermal cracking, visbreaking, hydrocracking, catalytic cracking, steam cracking, and solvent extraction to name a few.

Cracking is a refining process involving the decomposition and molecular recombination of hydrocarbons, to form molecules suitable for motor fuels, monomers, and other petrochemicals. Generally, there are two types of cracking operations: (1) thermal cracking, whereby hydrocarbon feedstocks are exposed to high temperatures, on the order of 538° to 649° C. (1000° to 1200° F.), for varying periods of time, and (2) catalytic cracking, whereby hydrocarbon vapors at a temperature of approximately 399° C. (750° F.) are passed over a catalyst. Another process for the improvement of high boiling hydrocarbons is visbreaking, which consists of the thermal cracking of heavy oils, which are pyrolyzed, or cracked, under relatively mild conditions to produce products having lower viscosities. Typical process conditions include heating the heavy oil to between 427° and 524° C. (800° and 975° F.), at pressures between about 4.5 and 7.9 megapascals, absolute (MPaa) (65 and 1000 psia). As used herein, pressures given are absolute (or differential) unless gauge (g) is indicated.

There are several examples in the prior art demonstrating methods for the treatment and upgrading of high boiling hydrocarbons at or near critical conditions. There are several examples of the use of thermal cracking of high boiling hydrocarbons at or near critical conditions of the solvent. In U.S. Pat. No. 3,310,484, Mason et al. disclose the conversion of crude residua, asphaltenes, aromatic tars, and the like to lower boiling hydrocarbons. In U.S. Pat. No. 4,483,761, Paspek, Jr. discloses a process by which heavy hydrocarbons are cracked at temperatures greater than or equal to the critical temperature of the solvent. In U.S. Pat. No. 4,592,826, Ganguli discloses a non-catalytic process for upgrading materials such as coal, residual oils, tars sands and shale oils. In U.S. Pat. No. 4,615,791, Choi et al. disclose a method for visbreaking heavy oils using hydrogen donor hydrocarbon solvents at or near supercritical conditions. In U.S. Pat. No. 4,944,863, Smith et al. disclose a method for treating resids or heavy stocks by thermally hydrocracking the materials under conditions where the solvent is substantially in its supercritical or dense supercritical state. In U.S. Pat. No. 5,370,787, Forbus et al. disclose a method for thermal treatment of petroleum residua at elevated temperatures and pressures. In U.S. Pat. No. 5,443,715, Grenoble et al. disclose a method for upgrading steam cracker tars, using hydrogen donor diluents to prevent the thermal degradation reactions. In U.S. Pat. No. 5,496,464, Piskorz et al. disclose a method for conversion of heavy hydrocarbon oils in supercritical fluids, specifically catalytic conversion at temperatures and pressures at or greater than the critical temperature and pressure of the solvent. In U.S. Pat. No. 5,725,756, Subramanian et al. disclose the reduction of coke buildup in catalysts at near critical and supercritical conditions for the solvent.

Similarly, the prior art also shows examples of the extraction of high-boiling hydrocarbons under supercritical conditions. See for example, U.S. Pat. No. 4,341,619 to Poska, disclosing the supercritical extraction of tar sands at supercritical conditions in a mobile bed; U.S. Pat. No. 4,354,922 to Derbyshire et al., disclosing the integrated extraction of petroleum residua, refractory bottoms and coal to gasoline and middle distillate products under supercritical conditions; U.S. Pat. No. 4,376,693 to Warzel, disclosing the extraction of solid particulate material such as oil shale; and U.S. Pat. No. 4,482,453 to Coombs and U.S. Pat. No. 4,890,411 to Buccilli disclosing supercritical solvent extractions of deposits.

In addition, there are examples disclosing the hydrotreatment of high boiling hydrocarbons under supercritical conditions. The resulting product streams are rich in hydrocarbon product streams having lower boiling points relative to the feed streams. In U.S. Pat. Nos. 6,123,835 and 6,428,686, Ackerson et al. disclose a method by which the addition of hydrogen gas over a catalyst in a hydrotreatment processes is eliminated through the mixing of the oil to be treated with a solvent or diluent having the ability to "donate" hydrogen from the molecular structure of the solvent to the molecular structure of the heavy hydrocarbons, thereby providing a hydrogen source for the hydrotreatment process.

In each of the examples presented, the cracking/extraction/hydrotreatment of the high boiling hydrocarbon feed occurs generally at or near the supercritical conditions of the solvent. The present invention, however, converts high boiling hydrocarbons at or above the supercritical temperature and pressure of the feedstock-solvent mixture.

In the prior art, the low molecular weight constituents of petroleum or other hydrocarbon sources are typically recovered as shown in FIG. 1 by atmospheric distillation 10 to obtain straight run naphtha, distillates, gas oil, atmospheric resid, and the like. The atmospheric tower bottoms (ATB) residue 12 is usually further processed to increase the overall yield of the more valuable products, e.g. naphtha, distillates and gas oil. The ATB residue can contain a large portion of hydrocarbons boiling above 538° C. (1000° F.), as well as nitrogen, sulfur, organometallic compounds, and Conradson Carbon Residue (CCR), making it difficult to process. Frequently, a vacuum distillation tower 14 is employed to recover vacuum gas oil (VGO) 28. The vacuum tower bottoms (VTB) residue 16 is even more concentrated in high-boiling hydrocarbons, e.g. 538° C.+ (1000° F.+) hydrocarbons, as well as Conradson Carbon Residue (CCR), sulfur, nitrogen and organometallic compounds.

In typical refinery processing with a vacuum distillation tower 14, the VTB residue 16 (and/or the ATB) is fed to solvent deasphalting 18, a coker 20 and/or a hydrocracker 22 in various proportions, orders or combinations. The solvent deasphalting 18 contacts the residue with propane, butane, pentane or a like hydrocarbon solvent (either subcritical or supercritical, e.g. residuum oil supercritical extraction (ROSE) or conventional solvent deasphalting (DEMEX or SOLVAHL)) to separate deasphalted oil (DAO) 24 (and/or resins) from the asphaltenes 26. The DAO 24 has a lower CCR, sulfur, nitrogen and metals content than the atmospheric resid/vacuum resid feed.

The coker 20 subjects the VTB residue 16, the asphaltenes 26 from the solvent deasphalting 18, or a combination thereof, to thermal cracking and soaking at high tempera ture, e.g. 482° to 510° C. (900° to 950° F.), usually near atmospheric pressure, generally without solvent present. The vapors recovered and condensed are generally lower molecular weight products. A solid residue, known as coke, is formed in substantial quantities. Generally, coke only has solid fuel value.

The resid hydrocracker 22 receives the hydrocarbon feed and typically operates at about 6.9 to 20.7 MPaa (1000 to 3000 psia) and about 343° to 427° C. (650° to 800° F.), in the presence of a hydrocracking catalyst, with molecular hydrogen added from a hydrogen generation unit 27, to form lower molecular weight products while at the same time removing substantial amounts of CCR and sulfur, primarily in the form of H2S, as well as nitrogen and organometallic compounds. A hydrogen consumption of 178 to 356 standard cubic meters per cubic meter of oil (1000 to 2000 standard cubic feet per (42-gallon) barrel (SCFB) of oil) is typical. High pressure is needed to ensure the presence of hydrogen in the reaction mixture and the formation of insignificant amounts of coke, and high levels of feed CCR and/or metals present in the hydrocracker feed can easily poison the catalyst. Because of the potential for catalyst poisoning, a cheap but less effective catalyst is usually used in the hydrocracker 22, resulting in incomplete conversion of the high molecular weight compounds.

The low molecular weight products 28 from the vacuum tower 14, the coker 20 and the hydrocracker 22, as well as DAO 24 from the solvent deasphalting 18, are usually further processed in hydrotreaters or gas oil hydrocrackers 30 requiring large amounts of molecular hydrogen to catalytically upgrade the hydrocarbons and remove additional nitrogen and sulfur. Because the feed to the hydrocracker 30 has been pretreated to remove catalyst poisons, a more effective and more expensive catalyst can be used. A typical operating condition is approximately 10.3 MPaa (1500 psia) and 371° to 454° C. (700° to 850° F.).

Gas oil 32 from the atmospheric tower 10 and the hydrocracker 30 is then usually cracked in a fluidized catalytic cracking (FCC) unit 34, well known in the art, to produce additional naphtha and distillate.

SUMMARY OF INVENTION

The present invention converts hydrocarbons having boiling points greater than 538° C. (1000° F.), using supercritical conversion with a hydrocarbon solvating medium. The conversion occurs in a reaction zone at a temperature and pressure above the critical temperature and pressure of the hydrocarbon-solvent feed mixture. The desired reaction temperature can be achieved by simultaneously introducing the solvent-feed mixture and hot particulates into an essentially adiabatic reaction zone, wherein the feed-stock-solvent mixture is initially at a temperature below the desired reaction temperature to avoid premature coking, and the hot particulates are initially at a temperature considerably above the desired reaction temperature, such that the resulting reaction mixture has a thermal equilibrium at the desired reaction temperature.

In a first embodiment, there is provided a continuous method for substantially converting heavy hydrocarbons having normal boiling points above 538° C. (1000° F.), to hydrocarbons having normal boiling points below 538° C. (1000° F.). The method includes: (A) providing a feed mixture with high boiling hydrocarbons and solvating hydrocarbons having a normal boiling point less than 538° C. (1000° F.), at a weight ratio of the solvating hydrocarbons to the heavy hydrocarbons of at least 2:1; (B) introducing the feed mixture into a reaction zone containing hot particulate solids to form a reaction mixture; (C) maintaining the reaction mixture in the reaction zone at a temperature and pressure above the critical temperature and pressure of the feed mixture, for a period of 60 seconds or less, to deposit coke onto the solids and produce a first effluent stream comprising a suspension of the particulate solids in a mixture of solvating hydrocarbons, including converted hydrocarbons, having normal boiling points below 538° C. (1000° F.); and (D) separating particulate solids from the first effluent stream to produce a solids-lean second effluent stream. As used in the specification and claims, "hot particulate solids" are understood to be initially at a temperature above the thermal equilibrium temperature of the reaction mixture.

A second embodiment can further include: (E) partially condensing the second effluent stream to form a third effluent stream essentially free of solids and lean in hydrocarbons boiling above 538° C. (1000° F.) and a fourth effluent stream comprising a slurry mixture of liquid hydrocarbons and solids; (F) separating the third effluent stream into solvent and one or more product streams, wherein the solvent stream comprises hydrocarbons with normal boiling points between 32° C. (90° F.) and 538° C. (1000° F.), and the one or more product streams comprise converted hydrocarbons having normal boiling points below 538° C. (1000° F.); and (G) recycling at least a portion of one or more product streams as solvating hydrocarbons in the feed mixture to the reaction zone.

The method can further include the recycle of at least a portion of the slurry mixture from (E) to the reaction zone. Alternatively, it can comprise recycling at least a portion of the slurry mixture with solids from the first effluent stream separation to a regeneration zone, regenerating the solids to remove coke and form hot regenerated particulate solids, and recirculating the regenerated particulate solids to the reaction zone in (B). The regeneration can comprise combustion of coke deposited on the particulate solids in the presence of an oxygen-containing gas.

The conversion process desirably has a yield of 90 percent or greater, where high-boiling hydrocarbons having normal boiling points above 538° C. (1000° F.) are converted to useable hydrocarbons having boiling points lower than 538° C. (1000° F.). In addition, the conversion process can also include the preheating of the feed mixture to the reaction zone. The preheating is done to a temperature of between 260° and 399° C. (500° and 750° F.). In one embodiment, portions of the hydrocarbon feedstock and/or the solvating hydrocarbons can be heated separately, mixed together to form the feed mixture at a temperature between 260° and 399° C. (500° and 750° F.), and then introduced to the reaction zone.

The hot particulate solids separated from the first effluent can be regenerated in the regeneration zone, where the coke solids are combusted with an oxygen-containing gas, and inorganic solids are recirculated to the reaction zone. Regeneration is necessary as the conversion reaction results in the depositing of coke from the feedstock on the particulate solids. The method can further include the recirculation of hot particulate solids wherein the solids have a particle size distribution substantially from 25 to 350 microns. The particulate solids are desirably fluidized in both the reaction and regeneration zones of the transport reactor, and more desirably, maintained in the transport hydrodynamic regime in both the reaction and regeneration zones. The circulating hot particulate solids can comprise refractory oxides, and can be selected from $SiO_2$, $Al_2O_3$, $AlPO_4$, $TiO_2$, $ZrO_2$, $Cr_2O_3$, and mixtures thereof.

The regeneration zone is desirably maintained at a temperature in the range of from 593° to 1316° C. (1100° to 2400° F.) and a pressure within about 0.5 MPa (73 psi) of the pressure in the conversion zone. The solids are desirably retained in the regeneration zone for a period of less than 60 seconds. A conventional disengager and/or cyclonic separators can separate the solids from the first effluent stream. The method can also include withdrawing a portion of the regenerated solids and replacing the withdrawn solids with fresh particulate solids.

The method can further comprise recovering solvent from the second effluent and recycling the solvent in the feed mixture to the reaction zone. The weight ratio of the solvating hydrocarbons to heavy hydrocarbons in the feed mixture can be from 2:1 to 10:1. The solvating hydrocarbons desirably include hydrocarbons produced in situ during conversion of the heavy hydrocarbons, recovered from the second effluent stream and recycled to the reaction zone. Additionally, the solvating hydrocarbons in the feed mixture can comprise light naphthas with normal boiling points within the range of from 32° to 82° C. (90° to 180° F.), heavy naphthas with normal boiling points within the range of from 82° to 221° C. (180° to 430° F.), distillates with normal boiling points within the range of 221° to 343° C. (430° to 650° F.), and/or gas oils with normal boiling points within the range of 343° to 538° C. (650° to 1000° F.). As used in the specification and claims, a material is within a "range" of a specified characteristic if the material contains a majority by weight of component(s) within the specified range or any part of the range.

The feed mixture is desirably contacted with the particulate solids in the reaction zone for a period of from 10 to 30 seconds. Additionally, the temperature in the reaction zone is desirably maintained at between 371° and 593° C. (700° to 1100° F.). More desirably, the reaction zone temperature is maintained at between 454° and 538° C. (860° to 1000° F.). It is desired that the fluid phase of the reaction mixture in the reaction zone be maintained in a single-phase regime, outside the retrograde regime.

Another embodiment incorporates (A) through (D) of the first embodiment and further includes: (E) hydroprocessing the second effluent stream produced in (D) in the presence of a hydrogen source and a hydroprocessing catalyst in a hydroprocessing zone at temperatures and pressures sufficient to maintain the second effluent stream in a single phase to produce a hydroprocessed second stream; (F) recovering the hydroprocessed second effluent from the hydroprocessing zone; and (G) separating solvent and at least one product stream from the hydroprocessed second effluent. The hydrogen source can be present in situ in the second effluent stream, or it can be added as a hydrogen rich gas stream.

Another embodiment incorporates (A) through (G) of the second embodiment, and further comprises: (a) hydroprocessing at least a portion of the third effluent stream produced in (E) in the presence of a hydrogen source and a hydroprocessing catalyst in a hydroprocessing zone at temperatures and pressures sufficient to maintain the effluent stream in a single phase to produce a hydroprocessed third effluent stream containing the solvent and the portion comprised of hydrocarbons having normal boiling points of 538° C. (1000° F.) and below; (b) recovering the hydroprocessed third effluent stream from the hydroprocessing zone; and (c) separating the solvent from the hydroprocessed third effluent stream recovered in step (b). The hydrogen source can be present in situ in the second effluent stream, or it can be added as a hydrogen rich gas stream.

A further embodiment of the invention provides a method for the production of hydrocarbon products selected from fuels, olefins and a combination thereof, comprising: (A) providing a feed mixture of heavy hydrocarbons having normal boiling points above 538° C. (1000° F.) and solvating hydrocarbons comprising normal boiling points below 538° C. (1000° F.) at a weight ratio of the solvating hydrocarbons to heavy hydrocarbons of at least 2:1, (B) introducing the feed mixture into a reaction zone containing hot particulate solids to form a reaction mixture, (C) maintaining the reaction mixture in the reaction zone at a temperature and pressure above critical temperature and pressure of the feed mixture for a period of 60 seconds or less to deposit coke onto the solids and produce a first effluent stream comprising a suspension of the particulate solids in a mixture of solvating hydrocarbons, including converted hydrocarbons, having normal boiling points below 538° C. (1000° F.), (D) separating particulate solids from the first effluent stream to produce a solids-lean second effluent stream, treating at least a fraction of the solids-lean second effluent by catalytic reforming, catalytic cracking, hydrotreating, hydroprocessing, or other like process, or a combination thereof, to produce lower molecular weight hydrocarbons, and (F) separating or blending the lower molecular weight hydrocarbons to obtain at least one product selected from the group consisting of motor fuels, olefins, petrochemical feedstocks and combinations thereof.

DETAILED DESCRIPTION

Figure 1:
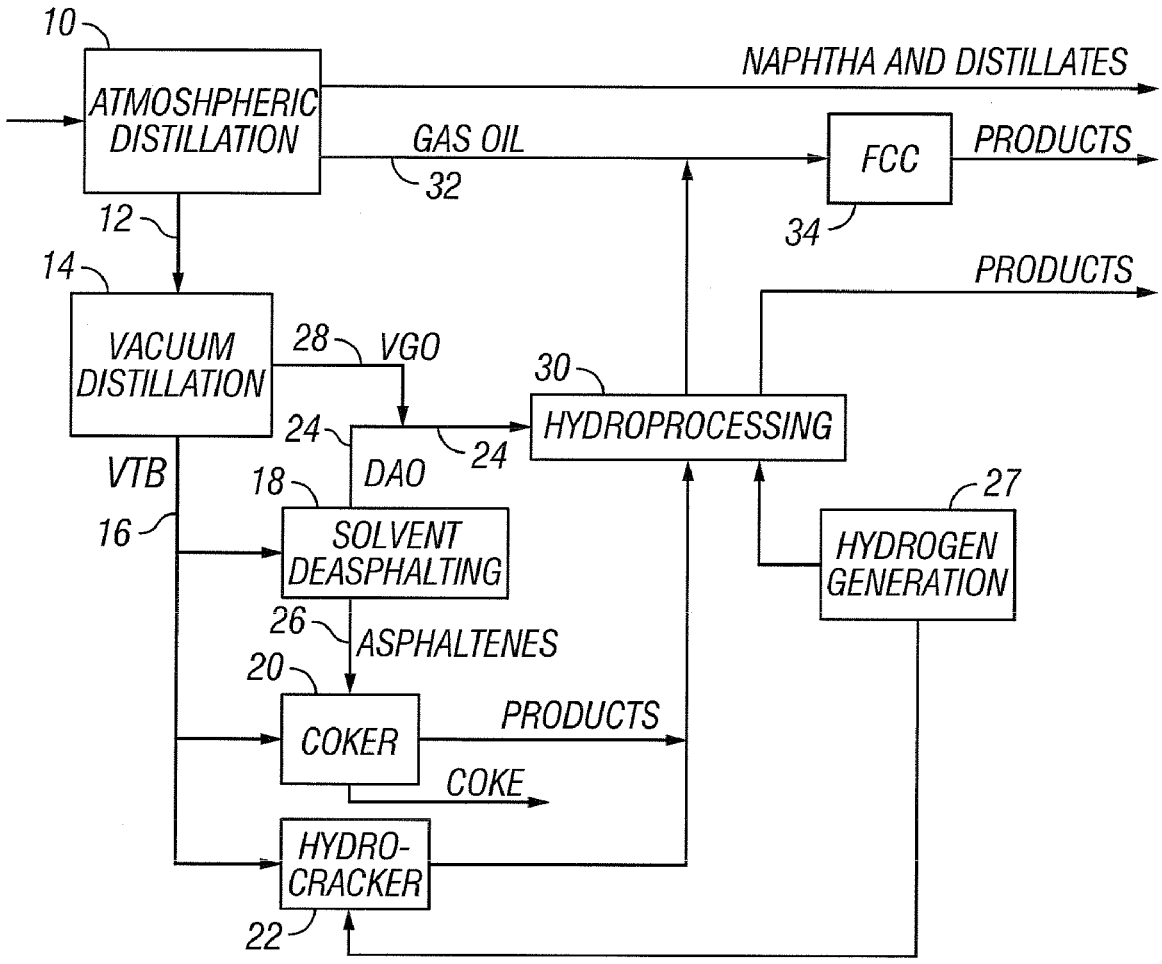
FIG. 1 (Prior Art)
FIG. 1 is a simplified schematic diagram of a typical prior art refinery configuration.

The present invention addresses the processing of petroleum and hydrocarbons from other feedstock sources, desirably its fractions and similar materials containing hydrocarbons having boiling points greater than 538° C. (1000° F.), using supercritical conversion with a hydrocarbon or mixture of hydrocarbons as the solvating medium for the high boiling hydrocarbon feed. The conversion occurs in a reaction zone at a temperature above the critical temperature of the hydrocarbon feedstock-solvent mixture, which can be estimated by employing conventional equation of state calculations. The desired reaction temperature can be achieved by simultaneously introducing the solvent-feed mixture and the hot particulates into the reaction zone, wherein the feedstock-solvent mixture is preheated to a temperature below the desired reaction temperature to avoid premature coking, and the hot particulates initially are at a temperature considerably above the desired reaction temperature, such that the resulting reaction mixture has a thermal equilibrium at the desired reaction temperature.

The reaction zone pressure is desirably maintained between 4.8 to 13.8 MPaa (715 to 2015 psia), more desirably between 5.5 to 12.4 MPaa (815 to 1815 psia), and even more desirably between 8.3 to 11.0 MPaa (1215 to 1615 psia). The temperature is desirably maintained between 371° to 593° C. (700° to 1100° F.), and more desirably between 440° to 524° C. (825° to 975° F.). It is very important that the critical pressure and temperature of the mixture are achieved, rather than just the critical temperature and pressure of the solvating hydrocarbons.

Ideally, the solvating hydrocarbon-feedstock mixture is desirably present in a single phase. It is believed the conversion at conditions within the retrograde regime of the fluid phase can lead to increased coke production. Higher conversion temperatures tend to facilitate the conversion to lower molecular weight products due to kinetic effects, but considerably higher temperatures lead to reduced selectivity and produce more gaseous hydrocarbons and/or light ends. It is understood that some material from the high boiling hydrocarbon feedstock may remain in solid form deposited on the original circulating solids. These deposited solids will generally recirculate with the hot particulate solids during regeneration, will build up on the circulating solids and may be purged periodically along with a purge stream of particulate solids.

As used herein, the term "high-boiling hydrocarbons" is used to refer to hydrocarbons with a normal boiling point above 538° C. (1000° F.). High-boiling hydrocarbons can be present in a variety of materials, including but not limited to: crude oil, atmospheric tower bottoms, vacuum tower bottoms, deasphalted oils, visbreaker tars, hydrotreater bottoms, resid hydrotreater bottoms, hydrocracker resid and gas oils, coker gas oils, asphaltenes, FCC slurry oils, bitumens, tar sand bitumens (including inherent inert matter such as sand), naturally occurring heavy oils, combinations thereof and the like. When used in reference to a source material, the term "high-boiling hydrocarbons" is intended to refer to the fraction of the source material hydrocarbons boiling above 538° C. (1000° F.). It is understood that some of the source material can contain some fractions boiling below 538° C. (1000° F.), as well as some fraction of material that is insoluble in hydrocarbon solvents.

The processing can be used in conjunction with the vacuum tower, solvent deasphalting, coker (delayed coker, fluid coker, and/or Flexicoker), visbreaker, hydrocracker, resid hydrotreater, hydrotreater, and/or FCC; or it can desirably be used to replace any or all of these units and/or to reduce the load on such units. This invention is particularly attractive for treating high-boiling hydrocarbons in the form of, or obtained from, source materials having an API gravity less than 25 and Conradson Carbon Residue (CCR) greater than 0.1 weight percent. The conversion is desirably effected in the presence of a major portion of a solvating hydrocarbon, with heating supplied by hot solid particles, at carefully selected supercritical mixture conditions to convert the high boiling hydrocarbons to lower boiling hydrocarbons with good selectivity to naphtha, distillates, and gas oils while having low gas production and coke formation, and reducing or desirably essentially eliminating Conradson Carbon Residue (CCR). In addition, sulfur, nitrogen and organometallic compounds are reduced in the converted hydrocarbon liquid products.

The solvating hydrocarbons initially added to the feedstock, if necessary, are desirably aliphatic, cycloaliphatic, or aromatic hydrocarbons, or mixtures thereof. Desirably, the solvating hydrocarbons are a mixture of hydrocarbons defined by a boiling point range. As used herein, "solvating hydrocarbon" is used to refer to any hydrocarbon with a normal boiling point less than 538° C. (1000° F.), desirably less than 316° C. (600° F.). There can also be some conversion of the solvating hydrocarbons to lower-boiling hydrocarbons during the conversion of the high boiling hydrocarbons, especially when gas oils are present as solvating hydrocarbons, but such solvent conversion can be less pronounced for lower molecular weight hydrocarbons such as distillates, and minimal in the case of naphtha, present in the feedstock and solvating hydrocarbons mixture. Gas condensate with a boiling range of 27° to 121° C. (80° to 250° F.), or naphtha can be conveniently used as solvents, desirably light naphtha with a boiling range of 32° to 82° C. (90° to 180° F.), or heavy naphtha with a boiling range of 82° to 221° C. (180° to 430° F.).

It is understood that hydrocarbons recycled from the converted product can be used as solvating hydrocarbons and can be recycled from the product stream to the mixing step for mixing with the feedstock containing the high boiling hydrocarbons. At steady state, the solvating hydrocarbon can be conveniently obtained by flashing and/or distillation operations carried out with the product solution or a portion thereof. Examples of hydrocarbons obtained from the conversion process suitable as solvating hydrocarbons include, but are not limited to, light, heavy and full-range naphthas, distillates, and gas oils.

Normally, from an economic standpoint, it is desirable to minimize the cost of solvating hydrocarbons, especially where the solvent is imported into the process. In the present invention, however, the solvating hydrocarbons can be produced in excess of what is required for recycle to the conversion of the feedstock. If the solvent to feed ratio is too low, it can be difficult to simultaneously maintain supercritical reactor conditions and suitable reaction pressures and temperatures, and decreased conversion and/or excessive coke make with reactor fouling or plugging can result. The solvating hydrocarbons should desirably comprise a major portion of the feedstock-solvating hydrocarbon mixture, i.e. at a weight ratio of solvating hydrocarbon to high-boiling hydrocarbons of at least 2:1. Suitable feedstock-solvent mixtures can be obtained by mixing the feed source containing the high boiling hydrocarbons with additional solvent at a weight ratio of solvent:feed source from 2:1 to 10:1 or more, more desirably from 3:1 to 6:1. The exact ratio of solvent to feedstock that is desired depends upon a number of factors, especially the critical temperature of both the high boiling hydrocarbons and the solvating hydrocarbons. Because the high boiling hydrocarbons generally have high critical temperatures, it is necessary to combine them with a sufficient amount of solvating hydrocarbons having lower critical temperatures, thus resulting in a manageable critical temperature for the feedstock-solvating hydrocarbon mixture. Desirably, the mixture has a critical temperature between 204° to 538° C. (400° to 1000° F.), more desirably between 316° to 524° C. (600° to 975° F.).

In the various embodiments of the invention, the solid particulate material can be any material that provides a surface upon which to deposit coke, such as, for example, beach sand, the sand or other solids that occur in the production of naturally occurring bitumens or tar sands, glass beads, or the like. The solid particulate material desirably comprises a refractory oxide, such as, for example, $SiO_2$, $Al_2O_3$, $AlPO_4$, $TiO_2$, $ZrO_2$, $Cr_2O_3$, or the like, and mixtures or combinations thereof. The solids can be similar to the matrix (sans catalyst) produced for catalysts used in fluid catalytic cracking (FCC) and/or hydrotreating (HT) processes, or it can include spent FCC and/or HT catalyst from such a process. These matrix materials are used to support the transition metal catalysts used in processes such as hydrocarbon reforming, alkylation, isomerization, hydrotreating, cracking, hydrocracking, fluid catalytic cracking, hydrogenation, dehydrogenation, hydrodesulfurization, hydrodenitrogenation, hydrodemetallization, and the like. In certain embodiments of the present invention, coke may rapidly deposit on the surfaces of the solids in the reaction zone and may not be completely removed during regeneration, so that the presence of transition metal catalyst thus only has a transitory or no appreciable effect on the reactions in the reaction zone. Therefore, conventional spent FCC/HT catalytic materials can be employed in the process, where these are readily available at a lower cost than other suitable particulate solids. Although new FCC/HT catalytic materials could also be used, there will generally be no economic advantage to be realized because of their high cost.

The solids desirably have a particle size distribution of substantially between 25 and 350 microns, more desirably having an average particle size of approximately 100 microns, facilitating fluidization in a transport reactor. As used herein, the term "fluidized" refers to a gas-solid contacting process in which a bed of finely divided solid particles is lifted and agitated by a stream of gas. At low velocity, the solid particles remain in a zone called a "bubbling bed" and only a small fraction of the particles are conveyed out of such a zone. At high velocities the solid particles are carried along with the gas in what is referred to as a "transport hydrodynamic regime." In terms of the present invention, the fluidized solids result in residence times of the solids, solvating hydrocarbons, and feedstock materials in the reaction zone of less than 60 seconds, desirably less than 30 seconds, more desirably between 10 and 15 seconds. Desirably, the solids in the reaction zone and the regeneration zone are maintained in the fluidized and/or transport hydrodynamic regime.

The solids and hydrocarbon feedstock desirably mix in a mixing zone before entering a transport zone consisting of a riser. The solids and hydrocarbon feedstock-solvent mixture can desirably flow through the riser of the transport reactor at a rate of at least 1.2 meters/sec (4 ft/sec), more desirably at a rate of at least 2.1 meters/sec (7 ft/sec). This velocity is sufficient to transport any solids suspended within the hydrocarbon feedstock and/or solvating hydrocarbon, along with the particulate solid, to the regeneration zone. Movement of the solids present, including non-vaporized hydrocarbons and particulate solids, prevents the buildup of materials in the reactor.

The use of the transport reactor and circulating solids generally results in reduced coke formation. In prior art cracking reactors, coke formation has been a persistent problem, leading to undesirable byproducts, reactor and equipment fouling and plugging, and catalyst deactivation. Deactivation is particularly troublesome as regeneration and/or removal of the catalyst prohibits the continuous running of the process. Deactivation in the present invention is immaterial because the reaction does not rely on a transition metal catalyst.

Molecular hydrogen can optionally be added to the conversion zone, and can be added to the feedstock mixture, desirably from 18 to 1800 standard cubic meters per cubic meter (100 to 10,000 standard cubic feet per 42-gallon barrel (SCFB)) of the high-boiling hydrocarbons feed, more desirably between 36 to 900 standard cubic meters per cubic meter (200 and 5000 SCFB) of the high-boiling hydrocarbons feed, and especially up to the solubility limit of hydrogen in the feedstock-solvating hydrocarbon mixture at the supercritical temperature and pressure of the mixture. The addition of hydrogen can in some cases increase the conversion of hydrocarbons boiling above 538° C. (1000° F.), and remove sulfur and nitrogen through the formation of $H_2S$ and ammonia, while at the same time leading to decreased production of coke.

Coking is thought to result from overcracking and polymerization of coke precursors at the particulate surface. The coke deposited on the solids or otherwise formed in the reaction zone will be associated with or deposited on the particulate solids and will serve as a fuel source to regenerate and re-heat the solids by coke combustion for reintroduction to the reactor riser. The present use of the transport reactor, more specifically the regeneration and recirculation of the solid materials, facilitates continuous running of the conversion process for extended periods of time. Coke formed during the conversion process is advantageously used as a fuel to supply the heat to the circulating particulate solids during the regeneration process as needed to rapidly heat the feedstock mixture to reaction temperature. A portion of the solids, e.g. attrited fines, can, however, be withdrawn from the transport reactor, either periodically or continuously, and replaced with fresh solids as is necessary. For example, fines can be continuously removed with the regeneration off gas as a result of inherently incomplete cyclonic solids removal from the regenerator riser effluent, while the feedstock may contain additional solid particles. Alternatively, solids can be removed and added separately.

Regeneration of the solids takes place in the regeneration reactor where the solid particulates containing the deposited coke are mixed with sufficient quantities of steam and oxygen, to achieve partial oxidation of the coke and regeneration of the solids, raising the temperature of the solids to approximately 760° C. (1400° F.), and producing a low heating value gas stream. Desirably, the regeneration zone is maintained at a temperature range of between approximately 593° to 1316° C. (1100° to 2400° F.), and at a pressure of within 0.5 MPa (73 psi) of the pressure maintained within the conversion zone. For safety reasons, the steam/oxygen ratio is desirably equal parts of steam and oxygen on a weight basis. Alternatively, the combustion effected in the regeneration reactor takes place with the addition of an oxygen containing gas, without the presence of steam. The combustion can take place with an excess of oxygen, resulting in a CO free offgas, or with a substoichiometric amount of oxygen resulting in the production of a CO-containing offgas. In either case, if the coke recovered with the spent solids is insufficient to heat the solids during regeneration to maintain the reaction zone temperature, additional fuel such as gas or oil can be supplied to the regeneration. The regeneration riser desirably has a velocity of at least 0.3 meters/sec (1 ft/sec), and more desirably at least 1.2 meters/sec (4 ft/sec), resulting in a residence time of the solids in the regenerator of between 10 and 60 seconds.

The conversion product effluent comprises converted high boiling hydrocarbons, as well as solvating hydrocarbons initially present in the feedstock mixture. The conversion product effluent is desirably a mixture of hydrocarbon compounds having a normal boiling point of less than 538° C. (1000° F.), desirably less than 316° C. (600° F.), and even more desirably less than 221° C. (430° F.). A portion of the product effluent can be separated by conventional means to be recycled to the mixing step as the solvating hydrocarbon, as described above. If desired, distillation processes can be employed to isolate specific hydrocarbons or isomers, for example pentanes, hexanes, toluene, etc.

Where the high-boiling hydrocarbons contain Conradson Carbon Residue (CCR), sulfur compounds, nitrogen compounds, and organometallic compounds, the content thereof in the converted product is reduced relative to that of the feed. Typical petroleum residues can contain 0.1 to 8 weight percent sulfur, 0.05 to 3 weight percent nitrogen, up to 3000 ppmw metals, have a CCR from 0.1 to 30 weight percent or more, more typically a CCR from 2 to 25 weight percent. Desirably, the product has at least 80 percent less hydrocarbons boiling above 538° C. (1000° F.), at least 40 percent less CCR, at least 30 percent less sulfur, at least 30 percent less nitrogen, and at least 30 percent less metal; more desirably there is 90 percent conversion or removal of the hydrocarbons boiling above 538° C. (1000° F.), at least 80 percent less CCR, nitrogen, and metals, and at least 40 percent removal of sulfur; especially that there is essentially complete conversion or removal of the hydrocarbons boiling above 538° C. (1000° F.), CCR and metals, and at least 50 percent removal of sulfur and nitrogen.

Naphthas, distillates and gas oils can be further processed to yield more useful hydrocarbons. Naphtha is mainly used for motor gasoline and processed further for octane improvement by catalytic reforming. Distillate is used to produce diesel, jet fuels, kerosene and certain specialty solvents. Gas oils are normally used as feeds to catalytic cracking or hydrocracking.

The converted hydrocarbon product of the invention can be further used in a variety of processes aimed at end products such as the production of fuels, olefins, petrochemical feedstocks and other petroleum products. For example, naphtha recovered directly from petroleum crude is too low in octane (30 to 50 octane) to meet quality requirements for motor gasoline. Therefore, naphtha boiling in the range of between 82° and 221° C. (180° to 430° F.) can be upgraded by catalytic reforming for use as a fuel. The effluent produced by the supercritical conversion unit can be collected as product, recycled as solvating hydrocarbons to the feedstock mixing step, or further processed by conventional methods. For example, naphtha can be collected as product, recycled for use as a solvating hydrocarbon, or further processed in a conventional naphtha treatment process to yield gasoline. Similarly, distillates can be further processed to yield kerosene and diesel.

Hydroprocessing is another process used to improve the quality of the product. Mild hydrotreating removes sulfur, nitrogen, oxygen and metals, and hydrogenates olefins. In a typical hydrotreatment process, a solids-free hydrocarbon is introduced with molecular hydrogen into a hydrotreatment zone containing a hydrotreatment catalyst. It is important that the conversion effluent introduced to the hydrotreatment process is free of solids to prevent plugging and contamination of the hydrotreatment catalyst. If necessary, filters can be employed to further ensure the conversion effluent is free of solids. Desirably, the reaction zone of the hydrotreatment process is maintained at a temperature and pressure whereby the effluent is present as a single phase. More desirably, the hydrotreatment zone is maintained above the supercritical temperature and pressure of the effluent.

The product of the hydrotreatment process contains less nitrogen, sulfur, and heavy metals relative to the effluent feed. Desirably, the product of the hydrotreatment process will contain essentially no heavy metals and very low levels of sulfur and nitrogen. A portion of the product can be recycled as solvating hydrocarbons to the feedstock mixing step, or it can be further processed and/or separated as desired.

Catalytic cracking converts heavy distillate oil to lower molecular weight compounds in the boiling range of gasoline and middle distillate. The process is most often carried out in a fluidized-bed process where small particles of catalyst are suspended in upflowing gas. The lower molecular weight products can be further processed as necessary.

Figure 2:
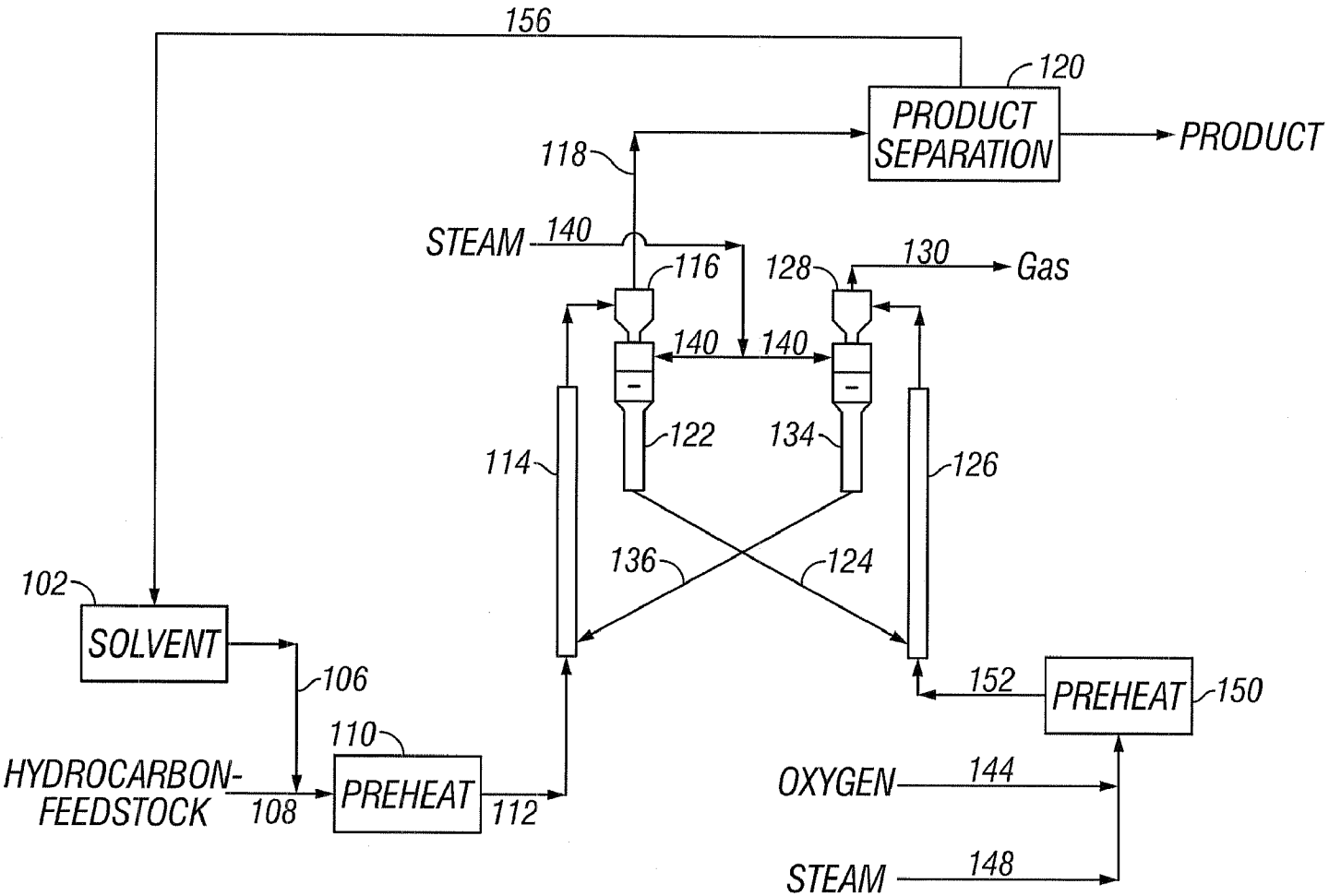
FIG. 2 is a simplified schematic diagram of the components of a refinery configuration according to an embodiment of the present invention wherein crude oil is processed in a supercritical conversion unit.

FIG. 2 represents one embodiment of the invention wherein the high boiling hydrocarbons in a feedstock are converted under supercritical conditions. Solvent 102 via line 106 is mixed with hydrocarbon feedstock via line 108, and the mixture is then fed to preheater 110 where the solvent-feedstock mixture is preheated to a temperature as high as possible without forming coke in the preheating unit. The preheated feedstock mixture is introduced into the riser 114 via line 112, where it is mixed with the hot solid particulates in a mixing zone. The solids entering the mixing zone have a temperature above that of the feedstock mixture and the reaction zone, to supply sufficient heat to heat the feedstock mixture to reaction temperature and to also supply the heat for the generally endothermic conversion of the high-boiling hydrocarbons.

The converted hydrocarbon effluent is separated from the solids via disengager/cyclone 116 and enters line 118. The effluent 118 is introduced to a product separation step 120 employing traditional separation means, producing converted hydrocarbon product stream 154 and recycled solvent stream 156, which can optionally be recycled via line 106 as mentioned above, or further processed as desired.

The solids separated by disengager/cyclone 116 enter stripper 122. The solids from stripper 122 enter regeneration riser 126 via cross over 124. Steam is introduced to stripper 122 via header 140. Oxygen, from a standard air separation unit, optionally together with steam, is introduced to preheater 150 via lines 144 and 148 respectively. The preheated oxygen/steam mixture is introduced into regeneration riser 126 via line 152, where it is combined with particulate solids containing coke and any residual hydrocarbons to produce a low heating value gas stream. The solids desirably have a velocity in the regeneration riser 126 of between 0.5 and 2 meters/sec (1.6 to 6.5 ft/sec), desirably resulting in residence times of between 10 and 40 seconds. The regenerated solids and any associated gas produced exit regeneration riser 126 and enter disengager/cyclone 128 where the solids and gases are separated. The low heating value gas exits via line 130 for further collection or processing via conventional methods. The regenerated solids enter stripper 134 where they are contacted with steam introduced via header 140. The regenerated solids are recirculated to reactor riser 114 via cross over 136.

Figure 3:
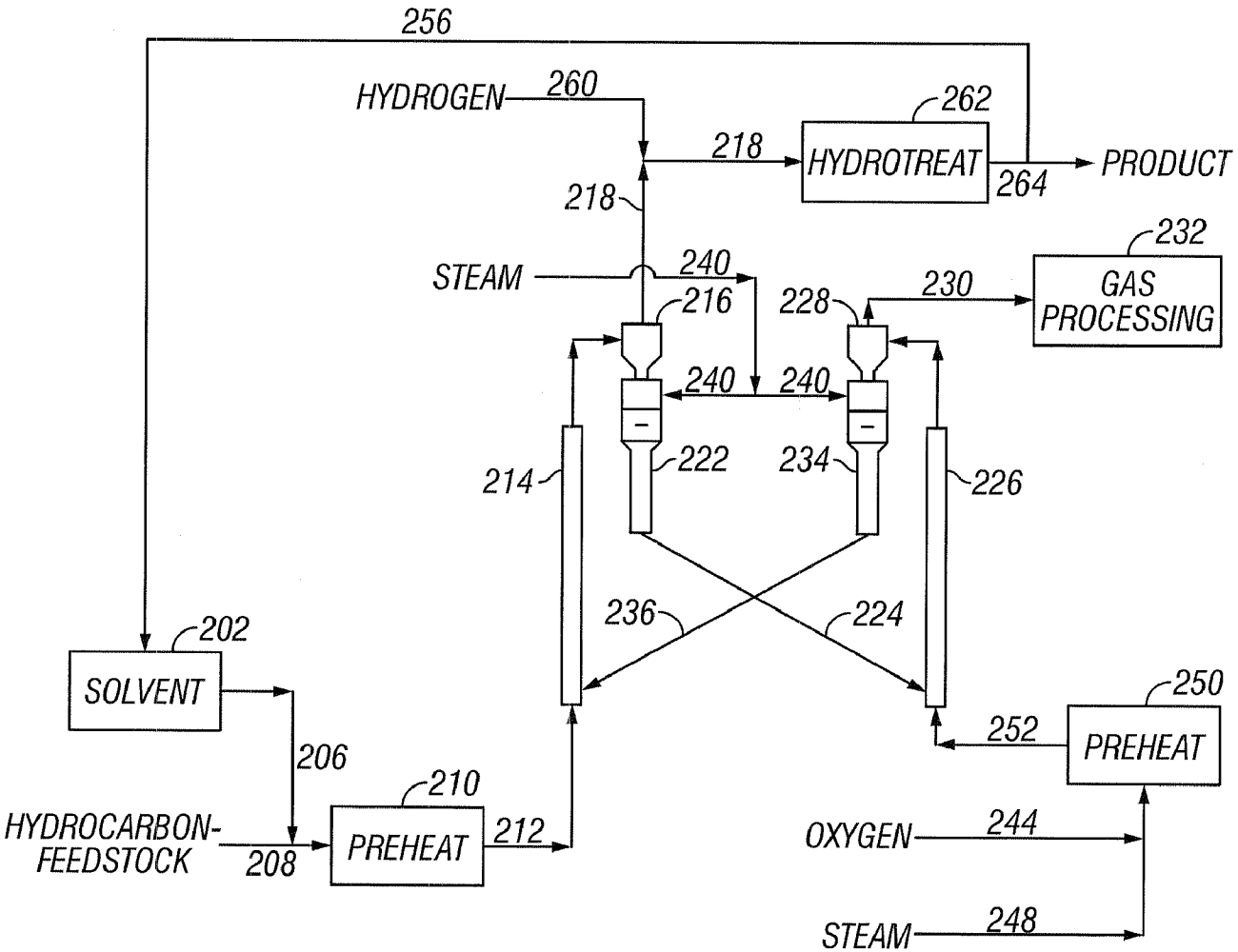
FIG. 3 is a simplified schematic diagram of a refinery configuration according to an embodiment of the present invention wherein crude oil is processed in a supercritical conversion unit, and further processed in a hydrotreating reactor.

Referring now to FIG. 3, there is represented an embodiment of the invention wherein the feedstock is first converted under supercritical conditions, and then further processed in a hydrotreating reactor. Solvent 202 and the high boiling hydrocarbon feedstock are mixed and added to preheater 210 via lines 206 and 208, respectively. The preheated feed mixture enters the riser 214 of a transport reactor via line 212, where it comes into contact with hot particulate solids. Upon contacting the hot particulate solids, the feed mixture achieves a supercritical reaction temperature.

The gaseous converted hydrocarbon effluent is separated from the solids by disengager/cyclone 216, and enters line 218. If necessary, residual solids are removed from the effluent prior to hydrotreating, e.g. by filtration, electrostatic precipitation, liquid contact, or the like. Hydrogen-containing gas enters line 218 via line 260, and is mixed with the converted hydrocarbon effluent. The amount of hydrogen used desirably does not exceed the hydrogen saturation point so that true single-phase conditions are maintained. The hydrogen-rich mixture enters hydrotreating reactor 262 where it contacts a conventional hydrotreating catalyst to produce a hydrotreated hydrocarbon effluent 264. The hydrotreating reactor is also desirably maintained at conditions above the supercritical temperature and supercritical pressure of the feed to the hydrotreating reactor. The hydrotreated effluent can be separated by conventional means into solvent 256 and one or more product streams. The solvent can be recycled with the hydrocarbon feedstock to the transport reactor, as previously mentioned.

The solids separated by disengager/cyclone 216 enter stripper 222, are treated with steam prior to entering regeneration riser 226 via reactor cross over 224. Steam enters strippers 222 and 234 via header 240. Oxygen, and optionally steam, is introduced to preheater 250 via lines 244 and 248 respectively. The preheated gas is introduced into regeneration riser 226 via line 252, where coke combustion and solids regeneration occur. The regenerated solids and associated gas enter disengager/cyclone 228 where the solids and gas are separated. Low heating value gas exits via line 230 for further collection or gas processing 232. The regenerated solids enter stripper 234, and are recirculated to reactor riser 214 via regenerator cross over 236.

Figure 4:
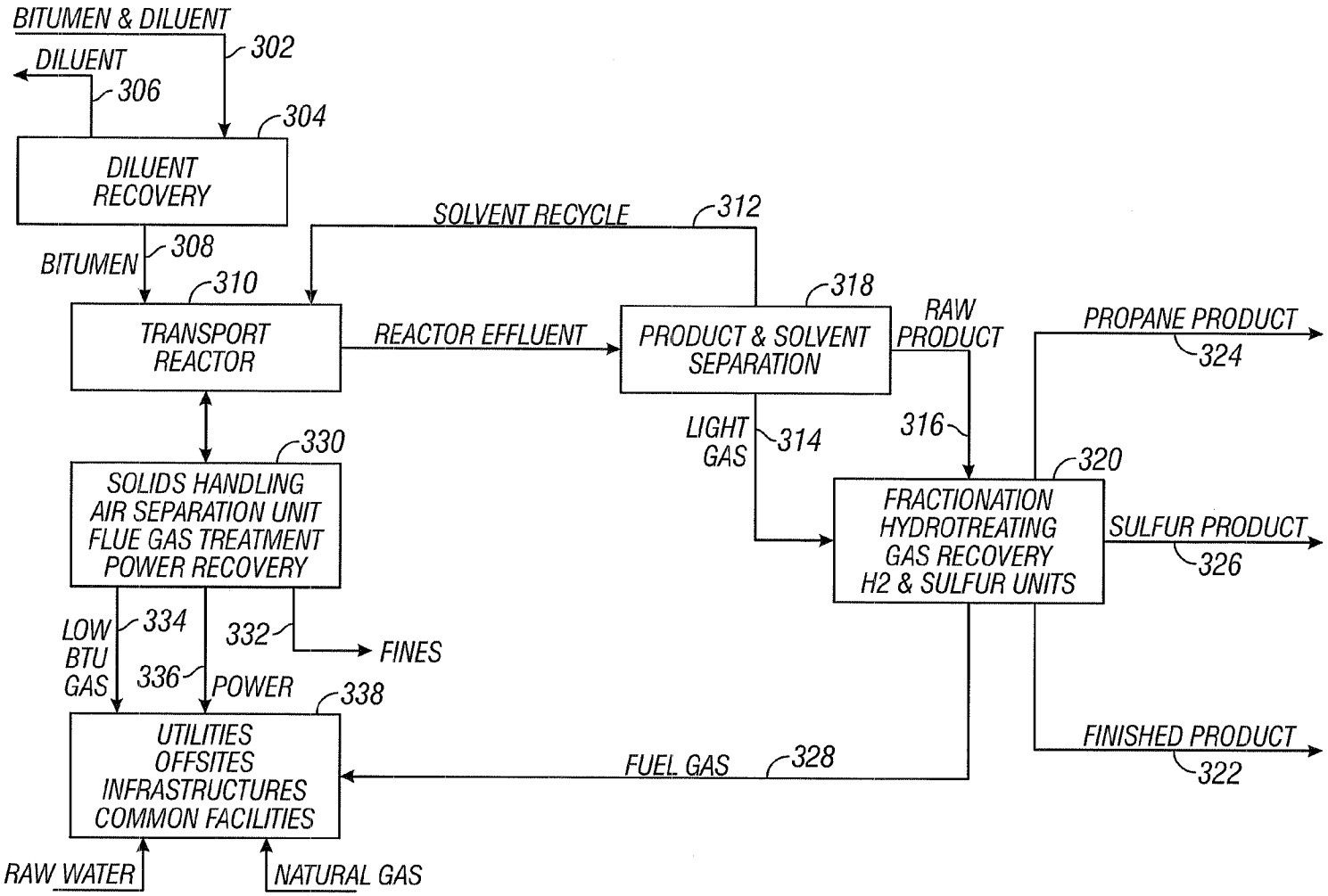
FIG. 4 is a simplified schematic diagram of an embodiment of the invention for processing bitumen pipelined with a separate upstream diluent.

FIG. 4 shows an application of the process of FIG. 2 in a bitumen processing scheme wherein a conventional hydrocarbon diluent is used to pipeline the bitumen from a production site, for example. The pipeline mixture 302 is supplied to conventional diluent recovery unit 304 to remove diluent, which is returned to the pipeline source via line 306. The recovered bitumen 308 is supplied to transport reactor unit 310 configured like transport reactor 114 shown in FIG. 2, along with solvent recycle 312 . The solvent recycle 312 and light gas 314 are separated from raw product 316 in product-solvent separation unit 318. The light gas 314 and raw product 316 are fed to processing unit 320 for fractionation, hydrotreating, gas recovery, hydrogen recovery and/or sulfur recovery, as desired, to obtain finished product stream 322 suitable for pipelining as a synthetic crude oil to a refinery or other destination, as well as propane product 324, sulfur product 326 and fuel gas 328. Reactor auxiliaries unit 330 includes a solids handling system for supplying makeup solids to the reactor unit 310 and processing spent solids and fines 332, an air separation unit for supplying regeneration oxygen, fuel gas treatment for the regeneration off gas to obtain a low heating value fuel gas 334, and/or a power recovery station including a turbine or other work recovery device to recover power 336 from fuel gas or process fluid expansion. Fuel gas 328, fuel gas 334, and power 336 can be supplied to common facilities unit 338 along with water and natural gas as needed for offsites and utilities, including process steam generation for the transport reactor unit 310.

Figure 5:
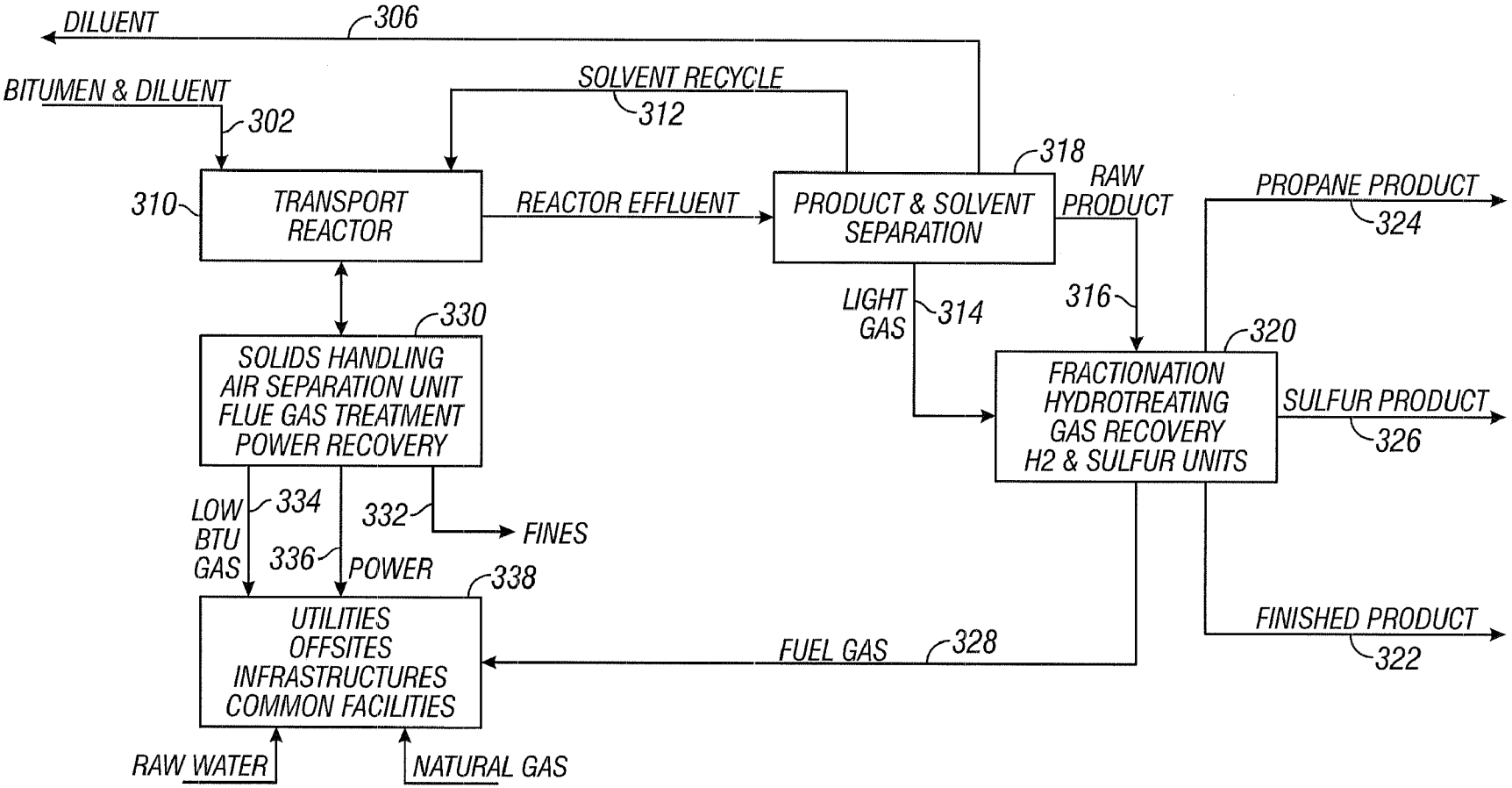
FIG. 5 is a simplified schematic diagram of one embodiment of the invention for processing bitumen pipelined with an upstream diluent used as a solvent in a transport reactor.

The arrangement of FIG. 5 is similar to that of FIG. 4 except that the bitumen-diluent pipeline mixture 302 is supplied as the feedstock directly to the transport reactor unit 310 without prior diluent removal. The diluent functions as a solvent in this case and additional solvent recycle 312 is supplied only as necessary to obtain the desired solvent: high-boiling hydrocarbon ratio. The diluent return 306 in this case, which can be the same as the recycle solvent or different, is obtained from the product-solvent separation unit 318.

Figure 6:
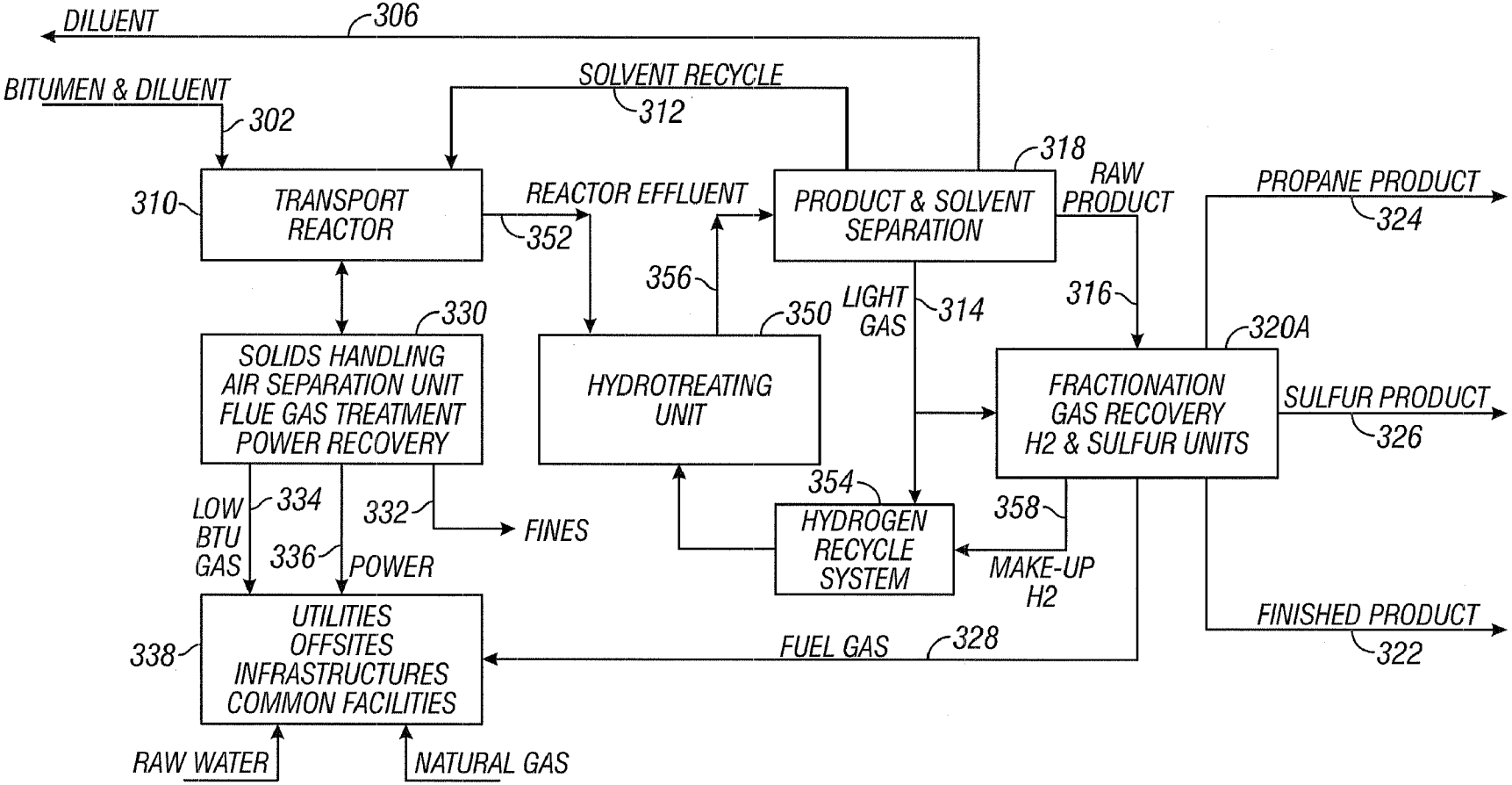
FIG. 6 is a simplified schematic diagram of one embodiment of the invention for processing bitumen pipelined with an upstream diluent used as a common solvent in a transport reactor and hydrogenation reactor in series.

The arrangement of FIG. 6 is similar to that of FIG. 5, but includes an integrated hydrotreating unit 350 configured with the transport reactor unit 310 as in the FIG. 3 process. The solids-free transport reactor effluent 352 containing both solvent and converted hydrocarbons is supplied directly to the hydrogenation unit 350 along with makeup hydrogen from hydrogen recycle system 354. The hydrogenated effluent 356 is then supplied to product-solvent separation unit 318. The processing unit 320A, which would no longer include the hydrotreating or all of the fractionation processing of processing unit 320 of FIGS. 4–5, can supply make-up hydrogen 358 to hydrogen recycle system 354. If desired, all or part of light gas 314 can have a sufficient hydrogen content to be used as an additional and/or alternative source of hydrogen to unit 350.

The invention is illustrated by way of the non-limiting examples which follow.

Figure 7:
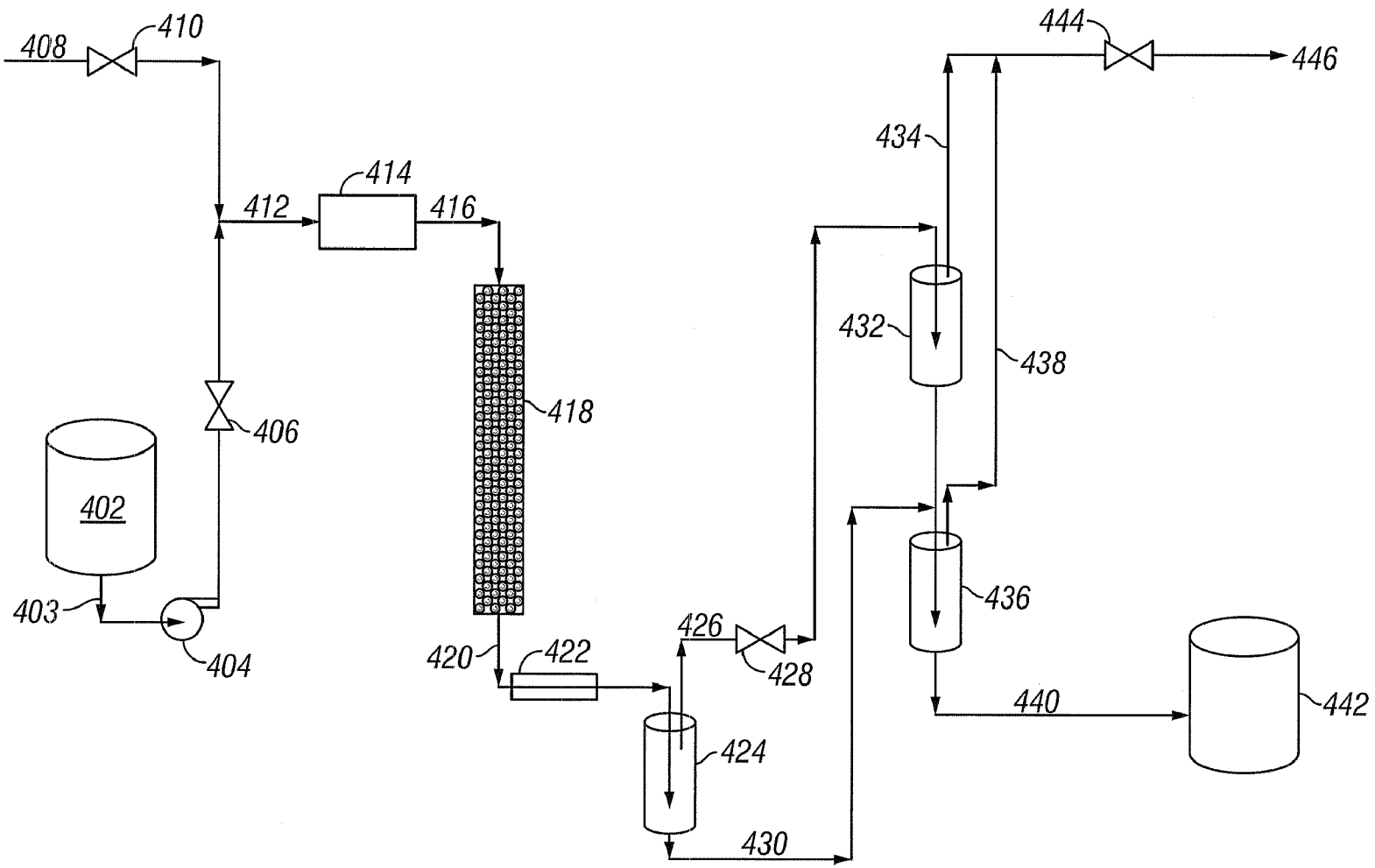
FIG. 7 is a schematic of an experimental apparatus used in the examples.

Experimental Apparatus: The experimental bench scale apparatus shown in FIG. 7 was used to process a feedstock comprising a portion boiling above 538° C. (1000° F.) over a fixed bed reactor to simulate the reaction conditions of the present invention. A hydrocarbon solvent and high boiling hydrocarbon source were introduced to the system from feedstock reservoir 402 via line 403, introduced via pump 404 and metered by control valve 406. The feedstock was mixed with molecular hydrogen, or an inert gas such as helium, introduced via line 408, and metered through valve 410. The feedstock-gas mixture was introduced to preheater 414 via line 412. The preheated mixture was then pumped via line 416 to fixed bed reactor 418 where the heavy hydrocarbons were converted to hydrocarbons having boiling points less than 538° C. (1000° F.). The converted hydrocarbons exited the reactor via line 420 and entered cooler 422 before the cooled product entered primary flash tank 424 where the effluent was separated into a gas and liquid phase. The liquid phase exits the primary flash tank 424 via 430 and enters liquid flash tank 436. The gas phase exited the primary flash tank via 426, was metered via valve 428, and entered a secondary flash tank 432, where further separation occurred. The liquid phase from secondary flash tank 432 combined with the liquid phase from primary flash tank 424 in liquid flash tank 436, exiting via line 440 and collected as product 442. The gas phase from secondary flash tank 432 was discharged via line 434, combined with the gas phase exiting liquid flash tank 436 via line 438, and metered via valve 444 into line 446 for further analysis.

Figure 8:
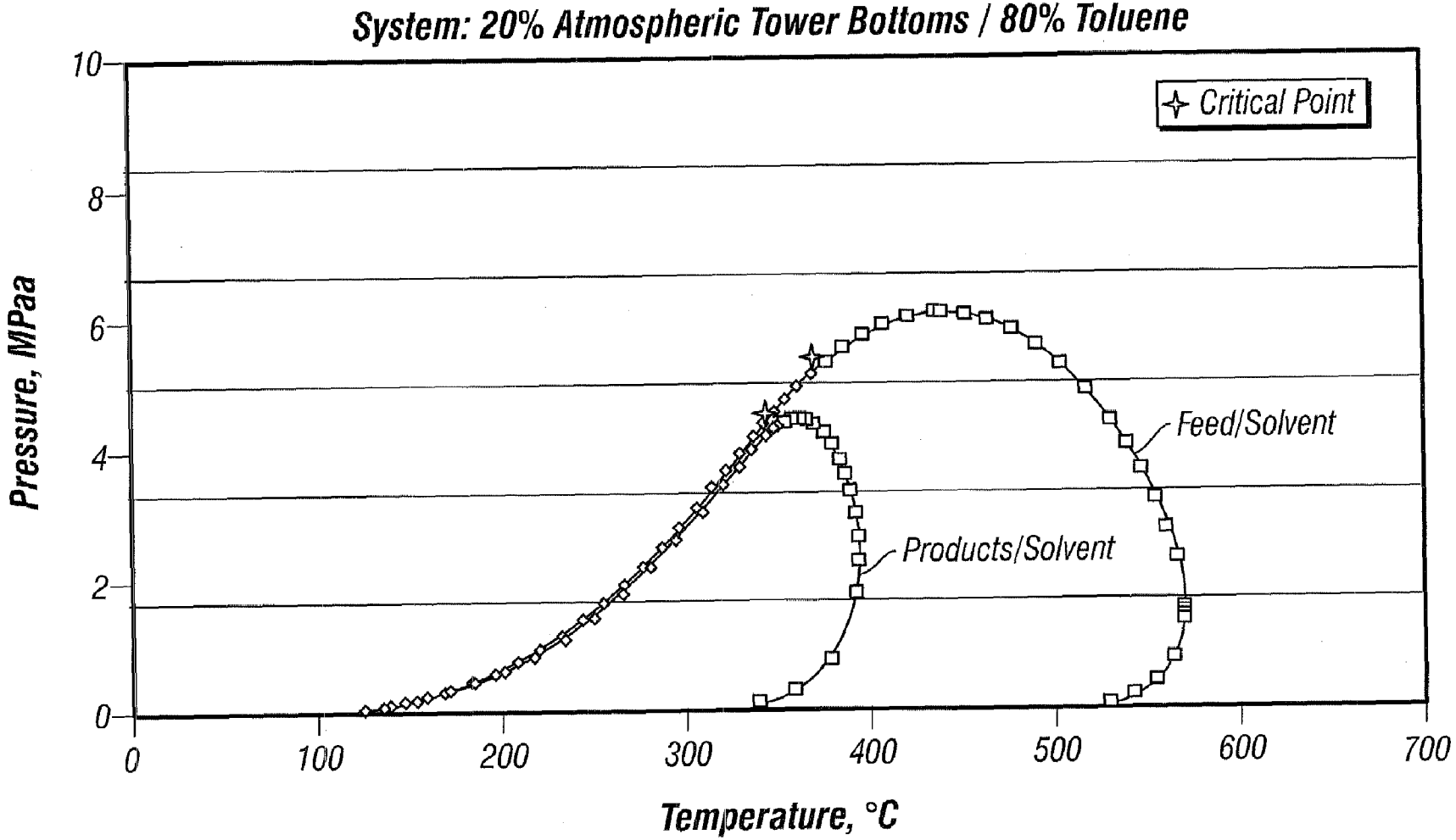
FIG. 8 is a typical pressure-temperature phase diagram for the feed system and products of the supercritical conversion process according to the present invention using atmospheric tower bottoms as feed and 80 weight percent toluene as solvent.

ATB:Toluene (1:4): The FIG. 7 apparatus was used with an alumina bed to treat a feedstock mixture comprising 20 weight percent ATB and 80 weight percent toluene at 454° C. (850° F.) and 10.1 MPaa (1465 psia). FIG. 8 shows a calculated pressure-temperature diagram for the saturated 20% ATB-80% toluene feed system and the reactor effluent product-solvent system collected from the reactor. The feed mixture has a substantially higher pressure-temperature curve (above and to the right) than the product curve (below and to the left). The critical points (*) on the curves in FIG. 8 indicate the product mixture has a lower supercritical pressure and temperature relative to the feed mixture. The supercritical conversion in the present invention occurs above the critical temperature (Tc) and pressure (Pc) of the feed mixture and the product mixture, also desirably above the cricondenbar.

Figure 9:
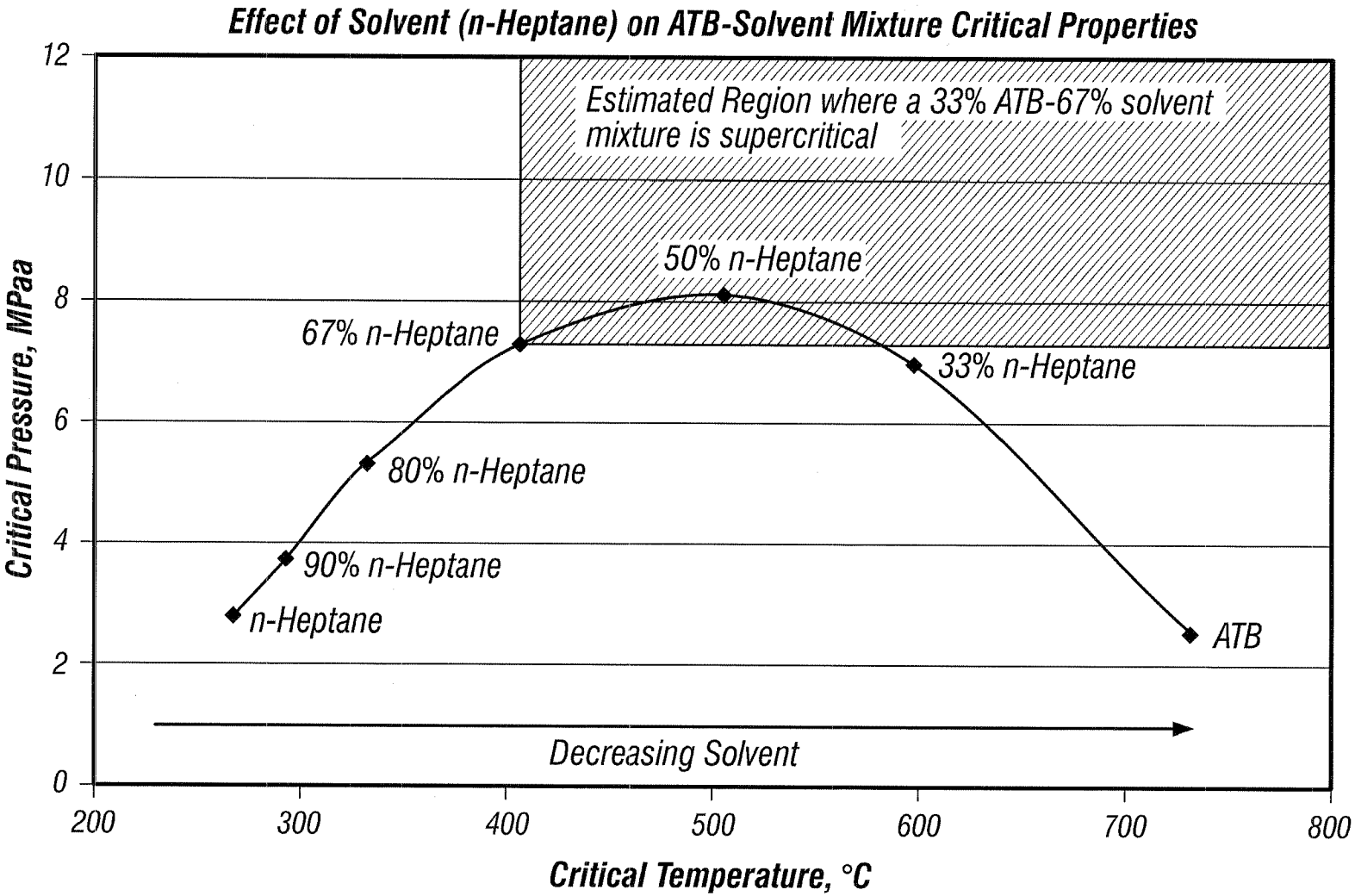
FIG. 9 is a critical pressure-temperature diagram showing the effect of the solvent composition on the estimated critical pressure and temperature for the ATB-heptane system.
Figure 10:
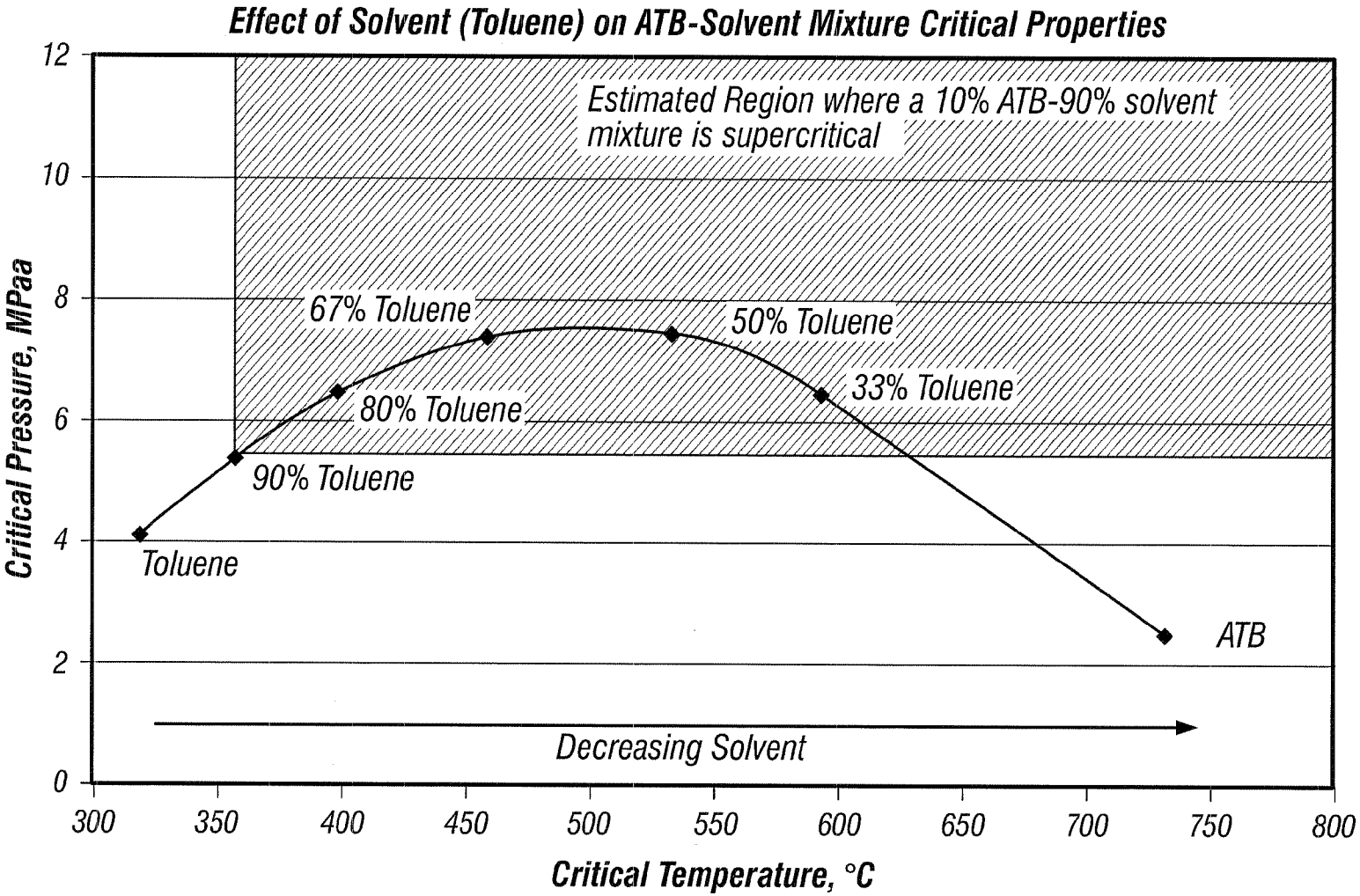
FIG. 10 is a critical pressure-temperature diagram showing the effects of the solvent composition on the estimated critical pressure and temperature for the ATB-toluene system.

ATB:n-Heptane, ATB:Toluene, VTB:Toluene Tc/Pc Curves: FIGS. 8–10 show Tc/Pc curves for ATB/n-heptane, ATB/toluene, and VTB/toluene mixtures, respectively. Because the high-boiling hydrocarbons have a relatively high critical temperature, the use of large solvating hydrocarbon dilution rates may be necessary to reduce the critical temperature of the mixture into the desired range. FIGS. 8–10 demonstrate the influences of proportion of solvent or solvating hydrocarbon used on the critical pressure (Pc) and temperature (Tc) of various feed mixtures. The critical pressures and temperatures were estimated using the Soave-Redlick-Kwong equation of state, with error ranges expected to be on the order of +/−8.3° C. (15° F. and +/−0.34 MPa (50 psi). For the ATB-heptane system in FIG. 9, for example, the Tc and Pc for ATB are 731° C. (1348° F.) and 2.5 MPaa (361 psia) respectively, and for n-heptane the Tc and Pc are 267° C. (513° F.) and 2.7 MPaa (397 psia). A 33 wt % n-heptane/67 wt % ATB mixture has a supercritical temperature of 596° C. (1106° F). At a 50—50 ratio, the Tc is lowered to 504° C. (940° F.). The desired temperature range to run the supercritical conversion is between 427° and 482° C. (800° and 900° F.), calling for the n-heptane concentration to be greater than 50 percent, desirably greater than 55%. Note also that the critical pressure for this mixture is greater than either the solvating hydrocarbons or ATB alone, as is typical for a mixed hydrocarbon system. However, when an 80 wt % n-heptane/20 wt % ATB mixture is used, the Tc is about 332° C. (629° F.) and Pc is about 5.3 MPaa (765 psia) for the feed mixture. Similar observations are evident from FIG. 10 for the ATB-toluene system.

Figure 11:
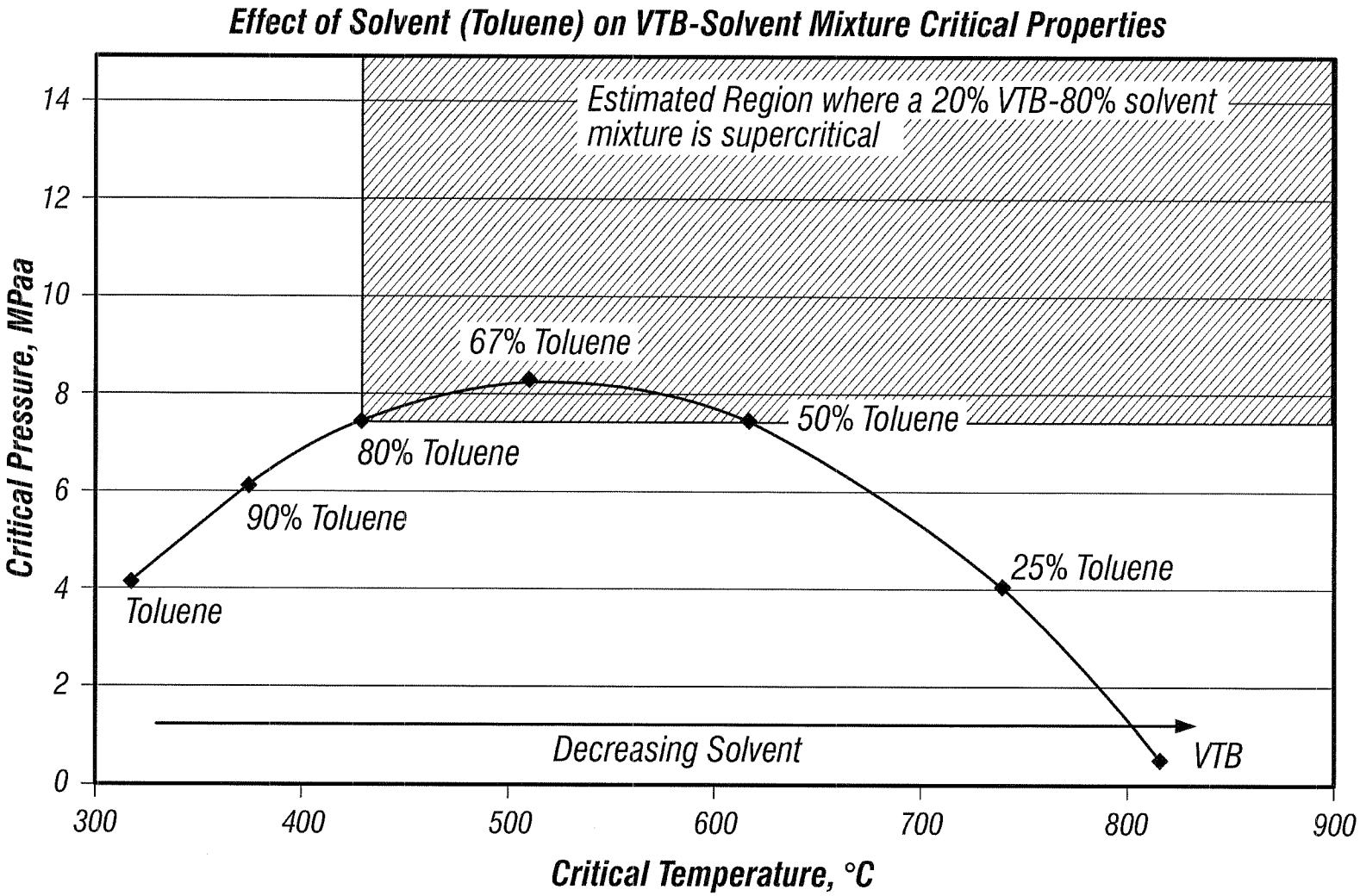
FIG. 11 is a critical pressure-temperature diagram showing the effect of the solvent composition on the estimated critical pressure and temperature for the VTB-toluene system.

FIG. 11 for the VTB-toluene system indicates a similar Tc/Pc trend, with a major difference being that VTB has a higher Tc than ATB, requiring more solvating hydrocarbons to bring the critical temperature of the solvating hydrocarbons-feedstock mixture to a suitable conversion temperature range. For example, at 50-weight percent toluene, the VTB-toluene mixture has a critical temperature of 617° C. (1142° F.), compared to a critical temperature of 429° C. (805° F.) for 80-weight percent toluene.

Figure 12:
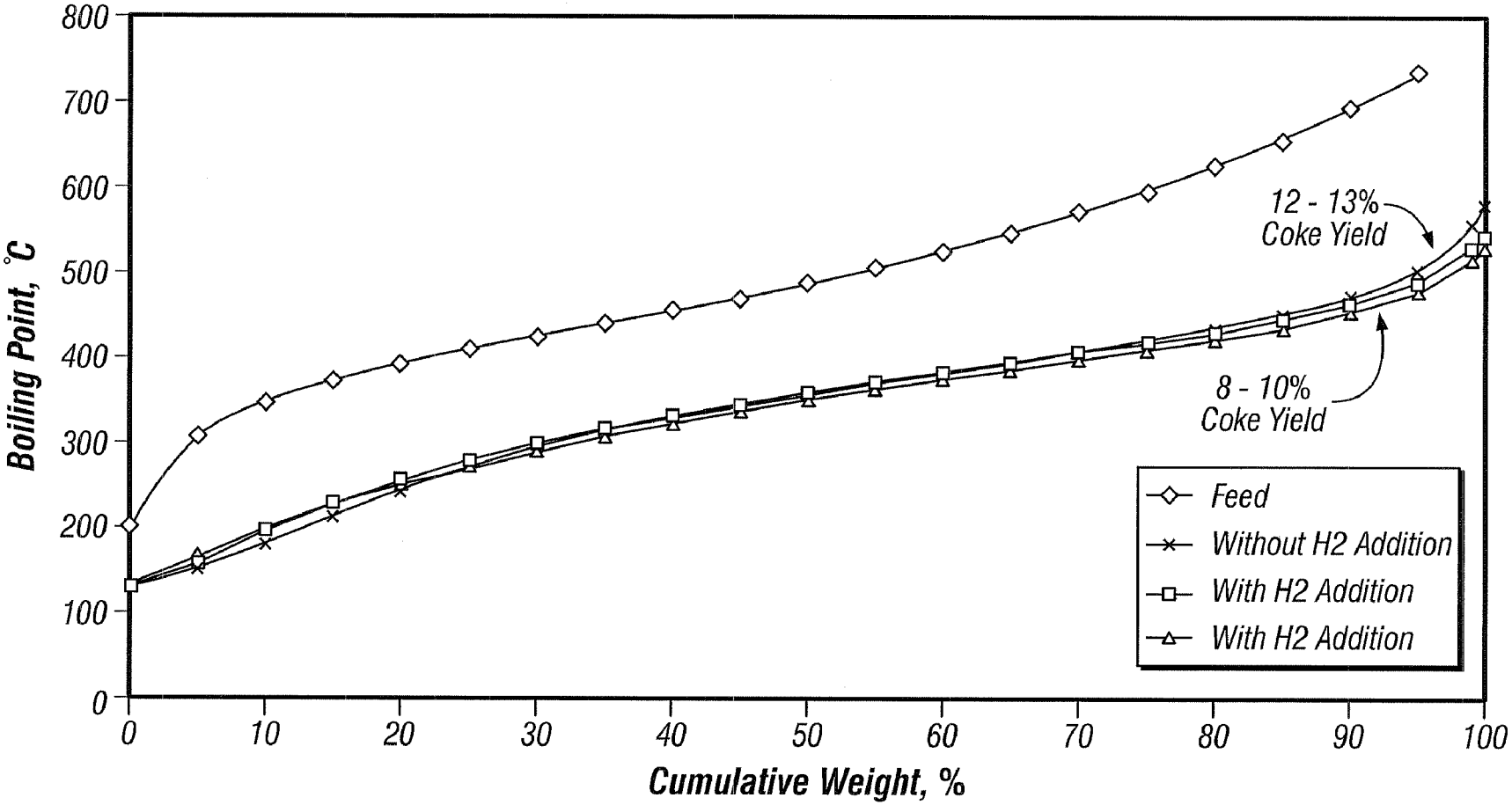
FIG. 12 is a boiling point curve for the simulated distillation of the products from a bitumen:toluene (1:4 by weight) feed mixture that has been supercritically processed, showing the effect of solid alumina and hydrogen on the conversion of the high boiling material.

Bitumen:Toluene (1:4) with and without Hydrogen: A bitumen:toluene (1:4, weight basis) feedstock mixture was converted over alumina at 454° C. (850° F.) and 10.1 MPaa (1465 psia) in the FIG. 7 apparatus, with and without hydrogen addition at 900 standard cubic meters per cubic meter of oil (5000 standard cubic feet per (42-gallon) barrel (SCFB) of oil). FIG. 12 shows a boiling point curve for a simulated distillation of the bitumen feed and the reactor products. Under supercritical conversion conditions, there was essentially complete conversion of the 538° C.+ (1000° F.+) feed material. The presence of hydrogen improved the conversion yield of high-boiling hydrocarbons only slightly, and reduced the coke yield from about 12–13% without hydrogen addition to about 8–10% with hydrogen addition.

Figure 13:
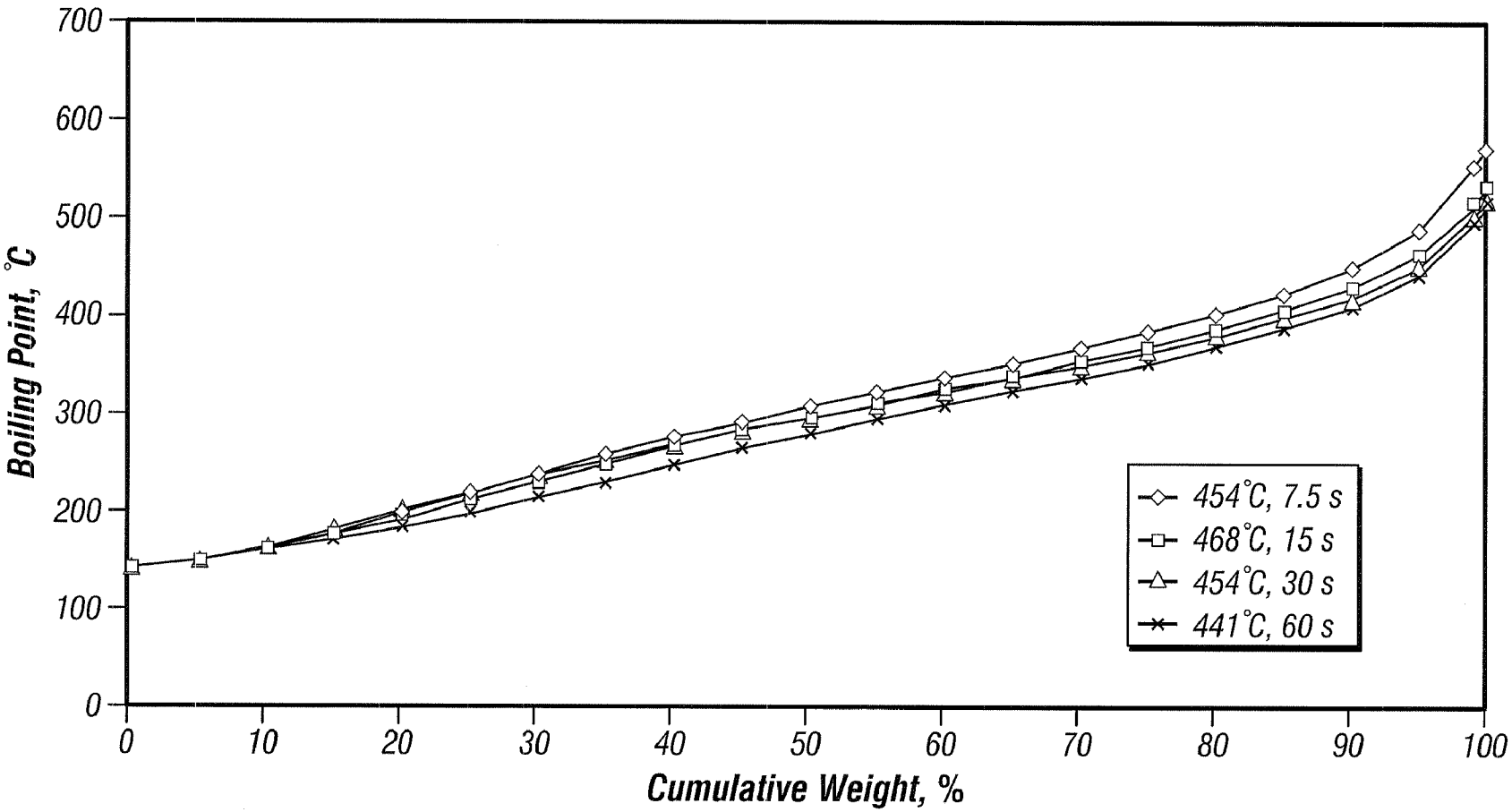
FIG. 13 is a boiling point curve for the simulated distillation of the products from a bitumen:toluene (1:4 by weight) feed mixture that has been supercritically processed over alumina, with varying temperatures and residence times.

Bitumen:Toluene, Effect of Time/Temperature: A bitumen:toluene (1:4, weight basis) feedstock mixture was converted over alumina at 10.1 MPaa (1465 psia) in the FIG. 7 apparatus, at varying reaction times and temperatures. FIG. 13 shows a boiling point curve for a simulated distillation of the bitumen feed and the reactor products. Essentially complete conversion of the 566° C.+ (1050° F.+) materials in the feed was achieved for the runs at the following residence times and temperatures: 15 seconds at 468° C. (875° F.), 30 seconds at 454° C. (850° F.), and 60 seconds at 441° C. (825° F.). A residence time of 7.5 seconds at 482° C. (900° F.) resulted in the conversion of approximately 90 percent of the 566° C.+ (1050° F.+) feed. While it is feasible to have conversion of the high boiling hydrocarbons at low residence times (i.e. on the order of less than 10 seconds), the higher temperatures required for such short residence times lead to less than complete conversion and lower selectivity to the lower boiling hydrocarbons.

Figure 14:
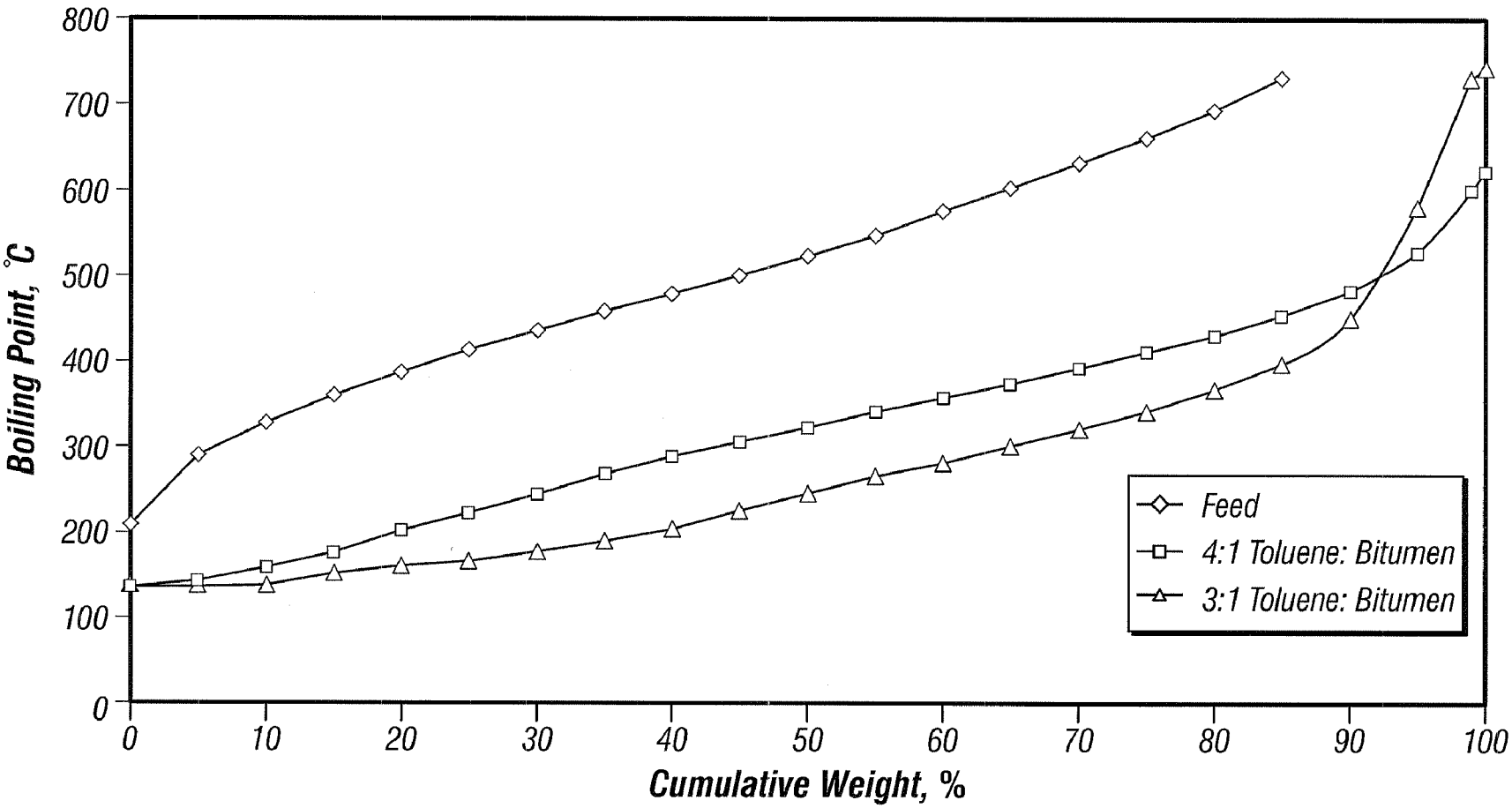
FIG. 14 is a boiling point curve for the simulated distillation of the products from a bitumen-toluene feed mixture that has been supercritically processed over alumina, demonstrating the effects of solvent:feed ratios.

Bitumen:Toluene (3:1 AND 4:1), EFFECT OF SOLVENT RATIO: A bitumen:toluene feedstock mixture was converted over alumina at 454° C. (850° F.) and 10.1 MPaa (1465 psia) in the FIG. 7 apparatus at feedstock:solvent weight ratios of 1:3 and 1:4 to investigate the effect of solvent dilution rates. The product boiling point curves seen in FIG. 14 show that increasing the solvent:feed ratio results in improved conversion of the 566° C.+ (1050° F.+) feed fraction and less conversion of the hydrocarbons boiling below about 427° C. (800° F.).

Hydrotreating Reactor Effluent with Solvent: To simulate the complete conversion and hydrotreatment of a high boiling feedstock, bitumen feedstock was first converted over alumina to lower boiling hydrocarbons and the resulting lower boiling hydrocarbons were then hydrotreated to remove inorganic impurities. The supercritical conversion was conducted approximately 50 times in an effort to obtain approximately 10 liters of converted product. In a typical conversion run, a 1:4 bitumen:toluene feedstock mixture was converted over alumina at 482° C. (900° F.) and 10.1 MPaa (1465 psia), without the addition of hydrogen. The conversions were run for less than 30 seconds each. Fresh alumina was added to the cracking reactor for each individual run. The resulting product was collected, distilled, and analyzed. The distillation separated fractions corresponding to hydrocarbon fractions having: (1) normal boiling point less than 132° C. (270° F.), (2) normal boiling point between 132° and 221° C. (270° and 430° F.), (3) normal boiling points between 221° and 343° C. (430° and 650° F.), (4) normal boiling points between 343° and 538° C. (650° and 1000° F.), and (5) normal boiling points above 538° C. (1000° F.). The fraction having normal boiling points less than 132° C. (270° F.) was collected to account for the toluene solvent present in the reaction mixture. The fractions, excluding the fraction having boiling points greater than 538° C. (1000° F.), were then recombined in the same proportion for hydrotreatment.

The hydrotreating runs were conducted using commercially available hydrotreating catalyst and toluene at a solvent to feedstock ratio of 4:1 on a weight basis. The catalyst was stabilized prior to hydrotreating the converted bitumen samples, by hydrotreating a 4:1 (weight basis) toluene:light cycle oil (LCO) mixture for 15 days. The hydrotreating reactor was operated at 371° C. (700° F.) and 9.8 MPaa (1415 psia), with liquid hourly space velocity (LHSV) of between 1.6 and 2.4/hr and hydrogen addition at a rate of 214 standard cubic meters per cubic meter of oil (1200 SCFB). The hydrotreating runs were conducted for a period of 16 hours. When not in use, the hydrotreatment system was purged and pressurized with hydrogen to maintain the hydrotreating catalyst in a reducing environment. Between each individual run, a light cycle oil (LCO):toluene sample was hydrotreated to ensure the activity of the hydrotreatment catalyst remained constant. The hydrotreated hydrocarbon product was then distilled into naphtha, distillate, and gas oil fractions. The results of the cracking and hydrotreatment are presented in Table 1.

TABLE 1

Integrated Conversion and Hydrotreating

| | Recovered Fraction | | | | | |
|---|---|---|---|---|---|---|
| | Naphtha 131°–221° C. (270°–430° F.) | | Distillate 221°–343° C. (430°–650° F.) | | Gas Oil 343°–538° C. (650°–1000° F.) | |
| | Conversion (1) or Hydrotreating(2) | | | | | |
| | 1 | 2 | 1 | 2 | 1 | 2 |
| Mass percent of whole hydrotreating reactor effluent including solvent (3) | 3.21% | | 5.05% | | 5.99% | |
| Density at 15° C. (59° F.), g/cc | 0.8349 | 0.8271 | 0.9077 | 0.8917 | 0.9869 | 0.951 |
| Total Sulfur, ppmw | 10400 | 347 | 20200 | 219 | 31900 | 1762 |
| Total Nitrogen, ppmw | 36 | 3 | 5000 | 103 | 2300 | 1042 |
| Carbon, weight percent | 85.9 | 87.6 | 84.8 | 87.4 | 84.0 | 88.6 |
| Hydrogen, weight percent | 12.2 | 12.4 | 11.2 | 11.8 | 10.7 | 11.2 |
| Paraffins, weight percent | 4.5 | | 7.9 | 14.0 | 2.9 | 4.9 |
| Iso-paraffins, weight percent | 12.6 | | | | | |
| Olefins, weight percent | 13.3 | | | | | |
| Naphthenes, weight percent | 9.7 | | | | | |
| Cycloalkanes, weight percent | | | 41.1 | 38.5 | 10.2 | 12.1 |
| Aromatics, weight percent | 56.1 | | 51.0 | 47.6 | 86.9 | 83.1 |
| Conradson Carbon Residue (CCR), weight percent | | | | | 0.7 | 0.2 |

1—Converted Bitumen (after supercritical conversion);
2—Hydrotreated hydrocarbon product;
3—Some of the bitumen contained and/or was converted to low boiling hydrocarbons or coke during the alumina reactor runs.
General Note:
ppmw = parts per million on a weight basis Hydrotreatment of the converted product leads to a reduction in the content of both sulfur and nitrogen in the product. Hydrotreatment of the naphtha fraction led to a reduction of sulfur of approximately 97% (by weight), and a reduction of nitrogen of approximately 92%. Hydrotreatment of the distillate fraction led to a reduction of sulfur of approximately 99% and a reduction of nitrogen of approximately 98%. Hydrotreatment of the gas oil fraction led to a reduction of sulfur of approximately 94% and a reduction of nitrogen of approximately 55%. Hydrotreatment of the gas oil fraction also showed a reduction in Conradson Carbon Residue (CCR) of approximately 71.4% (by weight).

Commercial Plant Simulation A preliminary design and simulation for a commercial plant for processing 198 cubic meters/hr (30,000 BPSD (barrels per stream day)) of bitumen with solvent recovery and recycle at a solvent:bitumen weight ratio of 4:1 was developed according to the process of FIG. 2. The bitumen feed 104 is mixed with the recycle solvent 102 (boiling point range 24 to 253° C. (76° to 488° F.) and preheated to 399° C. (750° F.). The reactor has a mixing zone made from a 4.9 meter (16 ft) long, 1 meter (39 in.) ID pipe with a 30 cm (12 in.) thick refractory lining, and a riser 114 made from a 19.5 meter (64 ft) length of 0.69 meter (27 in.) ID pipe also with a 30 cm (12 in.) thick refractory lining. The regenerated solids are supplied via crossover 136 to the reactor at 760° C. (1400° F.) at a weight ratio of feed mix:solids of 1:1 to obtain a reaction temperature of about 471° C. (880° F.) at a nominal pressure of about 10.1 MPaa (1465 psia). The reactor riser effluent is separated in a conventional cyclone 116 with a 0.76 meter (60 in.) ID, 2.3 meter (7.5 ft) long barrel and a 3.8 meter (12.5 ft) cone. The recovered solids have a delta-coke (change in weight % coke) of about 2 weight percent of the regenerated solids, and are regenerated with a 50:50 weight mixture of oxygen and steam preheated to 482° C. (900° F.). The process is started up using naphtha as the solvent, and at steady state the solvent recovered from the effluent for recycle to the reactor riser has a boiling point range from 24° to 253° C. (76° to 488° F.). The regenerator is operated at 760° C. (1400° F.) and a nominal pressure of about 10.1 MPaa (1465 psia), and has a mixing zone made from a 4.6 meter (15 ft) long, 0.69 meter (27 in.) ID pipe with a 30 cm (12 in.) thick refractory lining, and a riser 126 made from a 18.3 meter (60 ft) length of 0.46 meter (18 in.) ID pipe also with a 30 cm (12 in.) thick refractory lining. The regenerated solids are recovered from the regenerator riser effluent in a conventional cyclone 128 with a 1 meter (39 in.) ID, 1.5 meter (5 ft) long barrel and a 2.4 meter (8 ft) cone. The flow composition, flow rates, pressure and temperature of selected streams are presented in Table 2 that follows.

TABLE 2

Selected Streams in Commercial Plant for VTB Feed

| | Vacuum Tower Bottoms (VTB) | Solvent | Regenerated Solids | Reactor Product | Solids to Regeneration | Low Heating Value Gas |
|---|---|---|---|---|---|---|
| Stream Number | 108 | 106 | 136 | 118 | 124 | 130 |
| Mass Flow kg/hr | 201,282 | 805,127 | 1,001,361 | 1,029,640 | 1,023,502 | 140,716 |
| Nominal Pressure, MPaa | 10.3 | 10.3 | 10.1 | 10.1 | 10.3 | 10.1 |
| Temperature° C. | 149 | 116 | 760 | 471 | 471 | 750 |
| Component Flows, kg/hr | | | | | | |
| CO | 0 | 0 | 0 | 0 | 0 | 14,303 |
| CO2 | 0 | 0 | 0 | 0 | 0 | 46,114 |
| H2 | 0 | 0 | 0 | 0 | 0 | 1,730 |
| H2S | 0 | 0 | 0 | 604 | 0 | 2,353 |
| O2 | 0 | 0 | 0 | 0 | 0 | 0 |
| SOLIDS | 0 | 0 | 1,001,361 | 0 | 1,001,361 | 0 |
| COKE | 0 | 0 | 0 | 0 | 22,141 | 0 |
| WATER | 0 | 0 | 0 | 45,372 | 0 | 76,215 |
| C1–C4 | 0 | 0 | 0 | 3,522 | 0 | 0 |
| C5–C7 | 0 | 0 | 0 | 4,026 | 0 | 0 |
| 22–43° C. | 0 | 23,511 | 0 | 23,528 | 0 | 0 |
| 43–96° C. | 0 | 251,193 | 0 | 251,374 | 0 | 0 |
| 96–163° C. | 0 | 297,926 | 0 | 325,981 | 0 | 0 |
| 163–204° C. | 0 | 158,551 | 0 | 185,535 | 0 | 0 |
| 204–263° C. | 0 | 73,947 | 0 | 108,656 | 0 | 0 |
| 263–385° C. | 0 | 0 | 0 | 63,333 | 0 | 0 |
| 385–539° C. | 31,849 | 0 | 0 | 16,684 | 0 | 0 |
| 539–621° C. | 69,714 | 0 | 0 | 1,024 | 0 | 0 |
| 621–756° C. | 79,591 | 0 | 0 | 0 | 0 | 0 |
| 756–870° C. | 18,115 | 0 | 0 | 0 | 0 | 0 |
| 870–1027° C. | 2,013 | 0 | 0 | 0 | 0 | 0 |

Having described and illustrated the invention above with reference to non-limiting examples, various changes and modifications of the invention will become apparent to those skilled in the art. It is intended that all such changes and modifications within the scope or spirit of the appended claims be embraced thereby.

The invention claimed is:

1. A continuous method for substantially converting heavy hydrocarbons having normal boiling points above 538° C. (1000° F.) to hydrocarbons having normal boiling points below 538° C. (1000° F.), comprising:

(A) providing a feed mixture of the heavy hydrocarbons with solvating hydrocarbons comprising normal boiling points below 538° C. (1000° F.), at a weight ratio of the solvating hydrocarbons to the heavy hydrocarbons of at least 2:1;

(B) introducing the feed mixture into a reaction zone containing hot particulate solids to form a reaction mixture;

(C) maintaining the reaction mixture in the reaction zone at a temperature and pressure above critical temperature and pressure of the feed mixture for a period of 60 seconds or less to deposit coke onto the solids and produce a first effluent stream comprising a suspension of the particulate solids in a mixture of solvating hydrocarbons, including converted hydrocarbons, having normal boiling points below 538° C. (1000° F.); and (D) separating particulate solids from the first effluent stream to produce a solids-lean second effluent stream.

2. The method of claim 1 further comprising:

(E) partially condensing the second effluent stream to form a third effluent stream essentially free of solids and lean in hydrocarbons boiling above 538° C. (1000° F.) and a fourth effluent stream comprising a slurry mixture of liquid hydrocarbons and solids;

(F) separating the third effluent stream into solvent and one or more product streams, wherein the solvent stream comprises hydrocarbons with normal boiling points between 32° and 538° C. (90° and 1000° F.), a mixture of hydrocarbons selected from light naphthas comprising hydrocarbons with normal boiling points between 32° and 82° C. (90° and 180° F.), heavy naphthas comprising hydrocarbons with normal boiling points within the range of from 82° C. to 221° C. (180° to 430° F.), distillates with normal boiling points between 221° and 343° C. (430° F. and 650° F.), and gas oils with normal boiling points between 343 and 538° C. (650 and 1000° F.), and mixtures thereof, and the one or more product streams comprise converted hydrocarbons having normal boiling points below 538° C. (1000° F.); and (G) recycling at least a portion of the solvent as the solvating hydrocarbons in the feed mixture to the reaction zone.

3. The method of claim 2, further comprising recycling at least a portion of the slurry mixture from (E) to the reaction zone.

4. The method of claim 2, further comprising recycling at least a portion of the slurry mixture from (E) with solids from the first effluent stream separation to a regeneration zone, regenerating the solids to remove coke and form hot regenerated particulate solids, and recirculating the regenerated particulate solids to the reaction zone in (B).

5. The method of claim 4, wherein the solids regeneration comprises combustion of the coke in the presence of an oxygen-containing gas.

6. The method of claim 2, wherein the liquid hydrocarbons condensed from the second effluent stream is less than 10 weight percent of the heavy hydrocarbons provided in the feed mixture to the reaction zone.

7. The method of claim 1, further comprising preheating the feed mixture to the reaction zone.

8. The method of claim 7, wherein the feed mixture is preheated to a temperature from 260° to 399° C. (500° to 750° F.).

9. The method of claim 7, wherein a hydrocarbon feedstock comprising the heavy hydrocarbons and the solvating hydrocarbons are separately preheated and mixed to form the feed mixture to the reaction zone.

10. The method of claim 1, wherein heavy metals in the feedstock are deposited on the particulate solids.

11. The method of claim 4, wherein the regeneration of the circulating hot particulate solids comprises combustion of the coke in the regeneration zone in the presence of an oxygen containing gas.

12. The method of claim 11, wherein the hot particulate solids recirculated to the reaction zone have a particle size distribution 25 to 350 microns.

13. The method of claim 11, wherein the circulating hot particulate solids are fluidized in the reaction and regeneration zones.

14. The method of claim 11, wherein the circulating hot particulate solids are maintained in a transport hydrodynamic regime in the reaction and regeneration zones.

15. The method of claim 11, wherein the circulating hot particulate solids comprise refractory oxides.

16. The method of claim 15, wherein the refractory oxides are selected from $SiO_2$, $Al_2O_3$, $AlPO_4$, $TiO_2$, $ZrO_2$, $Cr_2O_3$, and mixtures thereof.

17. The method of claim 11, wherein the regeneration is at a temperature from 600° to 1300° C. (1112 ° to 2372° F.) and a pressure within about 0.5 MPa (73 psi) of the pressure in the reaction zone.

18. The method of claim 11, wherein the particulate solids are retained in the regeneration zone for a period of less than 60 seconds.

19. The method of claim 1, wherein the solids are cyclonically separated from the first effluent stream.

20. The method of claim 11, further comprising withdrawing a portion of the regenerated solids and replacing with fresh particulate solids to maintain a solids inventory.

21. The method of claim 1, further comprising recovering solvating hydrocarbons from the second effluent and recycling the solvating hydrocarbons in the feed mixture to the reaction zone.

22. The method of claim 1, wherein the weight ratio of solvating hydrocarbons to heavy hydrocarbons in the feed mixture is from 2:1 to 10:1.

23. The method of claim 1, wherein the solvating hydrocarbons include hydrocarbons produced in situ during conversion of the heavy hydrocarbons, recovered from the second effluent stream, and recycled to the reaction zone.

24. The method of claim 1, wherein the solvating hydrocarbons in the feed mixture comprise light naphtha with a normal boiling point range from 32° to 82° C. (90° to 180° F.).

25. The method of claim 1, wherein the solvating hydrocarbons in the feed mixture comprise heavy naphtha with a normal boiling point range from 82° to 221° C. (180° to 430° F.).

26. The method of claim 1, wherein the solvating hydrocarbons in the feed mixture comprise distillates with normal boiling points within the range of 221° to 343° C. (430° to 650° F.).

27. The method of claim 1, wherein the solvating hydrocarbons in the feed mixture comprise gas oils with normal boiling points within the range of 343° to 538° C. (650to 1000° F.).

28. The method of claim 1, wherein the feed mixture is contacted with the particulate solids in the reaction zone for a period of between 10 and 30 seconds.

29. The method of claim 1, wherein the temperature in the reaction zone is maintained at between 371° and 593° C. (700° and 1100° F.).

30. The method of claim 1, wherein the temperature in the reaction zone is maintained at between 454° and 538° C. (850° and 1000° F.).

31. The method of claim 1, wherein a fluid phase of the reaction mixture in the reaction zone is maintained in a single phase.

32. The method of claim 1, wherein a fluid phase of the reaction mixture in the reaction zone is maintained at a temperature and pressure outside the retrograde regime for the fluid phase.

33. The method of claim I, further comprising the steps of:

(E) hydroprocessing the second effluent stream from (D) in the presence of hydrogen and a hydroprocessing catalyst in a hydroprocessing zone at temperatures and pressures sufficient to maintain a single fluid phase in the hydroprocessing zone to produce a hydroprocessed effluent stream;

(F) recovering the hydroprocessed second effluent stream from the hydroprocessing zone; and (G) separating solvating hydrocarbons and at least one product stream from the hydroprocessed effluent stream.

34. The method of claim 33, wherein the hydrogen is present in situ in the second effluent stream.

35. The method of claim 33, further comprising adding a hydrogen-rich gas stream to the second effluent stream upstream from the hydroprocessing zone.

36. The method of claim 2, wherein the separation in (E) further comprises:

(a) hydroprocessing at least a portion of the third effluent stream in the presence of hydrogen and a hydroprocessing catalyst in a hydroprocessing zone at temperatures and pressures sufficient to maintain a single fluid phase in the hydroprocessing zone to produce a hydroprocessed effluent stream;

(b) recovering the hydroprocessed effluent stream from the hydroprocessing zone; and (c) separating solvent from the hydroprocessed effluent stream recovered from (b).

37. The method of claim 36, wherein the hydrogen is present in situ in the third effluent stream.

38. The method of claim 36, further comprising adding a hydrogen-rich gas stream to the third effluent stream.

39. A method for the production of fuels, petrochemical feedstocks and olefins, comprising:

(A) providing a feed mixture of heavy hydrocarbons having normal boiling points above 538° C. (1000° F.) and solvating hydrocarbons comprising normal boiling points between 32° C. and 538° C. (between 90° F. and 1000° F.) at a ratio of the solvating hydrocarbons to heavy hydrocarbons of from 2:1 to 10:1;

(B) introducing the feed mixture into a reaction zone containing hot particulate solids to form a reaction mixture;

(C) maintaining the reaction mixture in the reaction zone at a temperature and pressure above critical temperature and pressure of the feed mixture for a period of 60 seconds or less to deposit coke onto the solids and produce a first effluent stream comprising a suspension of the particulate solids in a mixture of solvating hydrocarbons, including converted hydrocarbons, having normal boiling points below 538° C. (1000° F.), wherein the reaction zone comprises a pressure from 4.8 to 13.8 MPa and a temperature from 454° to 538° C. (850° to 1000° F.);

(D) separating particulate solids from the first effluent stream to produce a solids-lean second effluent stream;

(E) treating at least a fraction of the solids-lean second effluent by catalytic reforming, catalytic cracking, hydrotreating, hydroprocessing, or a combination thereof, to produce lower molecular weight hydrocarbons; and (F) separating or blending the lower molecular weight hydrocarbons to obtain at least one product selected from the group consisting of motor fuels, olefins, petrochemical feedstocks and combinations thereof.

* * * * *